US011522291B2

(12) United States Patent
Karhade et al.

(10) Patent No.: US 11,522,291 B2
(45) Date of Patent: Dec. 6, 2022

(54) ANTENNA BOARDS AND COMMUNICATION DEVICES

(71) Applicant: Intel Corporation, Santa Clara, CA (US)

(72) Inventors: Omkar G. Karhade, Chandler, AZ (US); William James Lambert, Chandler, AZ (US); Xiaoqian Li, Chandler, AZ (US); Nitin A. Deshpande, Chandler, AZ (US); Debendra Mallik, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 835 days.

(21) Appl. No.: 16/230,636

(22) Filed: Dec. 21, 2018

(65) Prior Publication Data

US 2020/0203839 A1 Jun. 25, 2020

(51) Int. Cl.
*H01Q 9/04* (2006.01)

(52) U.S. Cl.
CPC ..... *H01Q 9/0428* (2013.01); *H01Q 9/0414* (2013.01); *H01Q 9/0464* (2013.01)

(58) Field of Classification Search
CPC ..... H01Q 9/04
See application file for complete search history.

(56) References Cited

U.S. PATENT DOCUMENTS 6,166,692 A * 12/2000 Nalbandian ..... H01Q 9/0428 343/770
2011/0273360 A1* 11/2011 Campero ..... H01Q 5/307 343/893

* cited by examiner

*Primary Examiner* — Andrea Lindgren Baltzell
(74) *Attorney, Agent, or Firm* — Akona IP PC

(57) ABSTRACT

Disclosed herein are antenna boards, antenna modules, and communication devices. For example, in some embodiments, an antenna board may include a plurality of antenna patches coupled to a dielectric material and a plurality of pedestals extending from a face of the dielectric material and at least partially embedded in the dielectric material.

20 Claims, 11 Drawing Sheets

ANTENNA BOARDS AND COMMUNICATION DEVICES

BACKGROUND

Wireless communication devices, such as handheld computing devices and wireless access points, include antennas. The frequencies over which communication may occur may depend on the shape and arrangement of the antennas, among other factors.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, not by way of limitation, in the figures of the accompanying drawings.

DETAILED DESCRIPTION

Figure 1:
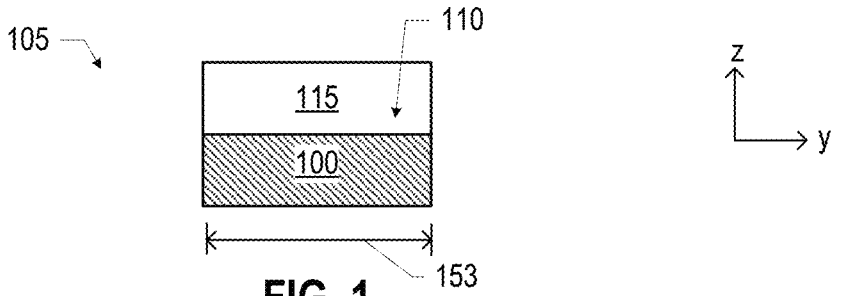
FIG. 1 is a side, cross-sectional view of an antenna module, in accordance with various embodiments.

Disclosed herein are antenna boards, antenna modules, and communication devices. For example, in some embodiments, an antenna board may include a plurality of antenna patches coupled to a dielectric material and a plurality of pedestals extending from a face of the dielectric material and at least partially embedded in the dielectric material.

At millimeter wave frequencies, antenna arrays integrated into electronic devices (e.g., mobile devices, such as handheld phones) may suffer significant losses due to de-tuning, absorption, and/or radiation pattern distortion. For example, in a mobile device environment, an antenna array may be inside a housing that includes a plastic or glass back cover, a metallic chassis, a metallic front display, and/or a metallic phone edge. The antenna array(s) may be located proximate to the phone edge. For conventional antennas designed for free space operation, operation in such a "real" electronic device environment may experience losses due to mismatch between the power amplifier signal and the antenna terminal, undesired reflection and surface waves at the glass/air interface (which may result in low radiation efficiency and radiation pattern distortion that induces undesired side lobes), and/or dielectric absorption of the plastic or glass back cover (which may also contribute to low radiation efficiency). For example, integration of a conventional antenna design into a mobile device environment may result in a 6-8 dB return loss level and a bandwidth reduced by half.

Various ones of the antenna boards and communication devices disclosed herein may exhibit improved performance to enable millimeter wave operation in mobile device and other electronic device environments. As discussed below, the designs disclosed herein may enable the antenna boards and communication devices disclosed herein to achieve broad bandwidth operation with high return loss and high gain. For example, some of the low cost, high yield designs disclosed herein may include air cavities that improve the impedance bandwidth and radiation efficiency over the operational bandwidth. Conventionally, the incorporation of air cavities into a device design has required expensive and/or difficult processing operations; various ones of the structures and processes disclosed herein may utilize lower-cost manufacturing techniques, such as lamination. The antenna board and communication device designs disclosed herein may be advantageously included in mobile devices, base stations, access points, routers, backhaul communication links, and other communication devices.

In the following detailed description, reference is made to the accompanying drawings that form a part hereof wherein like numerals designate like parts throughout, and in which is shown, by way of illustration, embodiments that may be practiced. It is to be understood that other embodiments may be utilized, and structural or logical changes may be made, without departing from the scope of the present disclosure. Therefore, the following detailed description is not to be taken in a limiting sense.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order from the described embodiment. Various additional operations may be performed, and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C). The drawings are not necessarily to scale. Although many of the drawings illustrate rectilinear structures with flat walls and right-angle corners, this is simply for ease of illustration, and actual devices made using these techniques will exhibit rounded corners, surface roughness, and other features.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. As used herein, a "package" and an "integrated circuit (IC) package" are synonymous. When used to describe a range of dimensions, the phrase "between X and Y" represents a range that includes X and Y. For convenience, the phrase "FIG. 5" may be used to refer to the collection of drawings of FIGS. 5A-5B, the phrase "FIG. 7" may be used to refer to the collection of drawings of FIGS. 7A-7B, etc.

Any of the features discussed with reference to any of accompanying drawings herein may be combined with any other features to form an antenna board 100, an antenna module 105, or a communication device 151, as appropriate. A number of elements of the drawings are shared with others of the drawings; for ease of discussion, a description of these elements is not repeated, and these elements may take the form of any of the embodiments disclosed herein.

FIG. 1 is a side, cross-sectional view of an antenna module 105, in accordance with various embodiments. The antenna module 105 may include an IC package 115 coupled to an antenna board 100. Although a single IC package 115 and a single antenna board 100 are illustrated in FIG. 1, an antenna module 105 may include more than one IC package 115 and/or one or more antenna boards 100 (e.g., as discussed below with reference to FIG. 17). As discussed in further detail below, the antenna board 100 may include conductive pathways (e.g., provided by conductive vias and lines through one or more dielectric materials) and feed structures 118 (including, e.g., striplines, microstriplines, or coplanar waveguides) (not shown) that may enable one or more antenna patches 104 (not shown) to transmit and receive electromagnetic waves under the control of circuitry in the IC package 115. In some embodiments, the IC package 115 may be coupled to the antenna board 100 by second-level interconnects (not shown, but discussed below with reference to FIG. 16). For example, the antenna board 100 may be surface mounted to the IC package 115. In some embodiments, at least a portion of the antenna board 100 may be fabricated using printed circuit board (PCB) technology, and may include between two and eight PCB layers. Examples of IC packages 115 and antenna boards 100 are discussed in detail below. In some embodiments, an antenna module 105 may include a different IC package 115 for controlling each different antenna patch 104; in other embodiments, an antenna module 105 may include one IC package 115 having circuitry to control multiple antenna patches 104. In some embodiments, the total z-height of an antenna module 105 may be less than 3 millimeters (e.g., between 2 millimeters and 3 millimeters).

Figure 2:
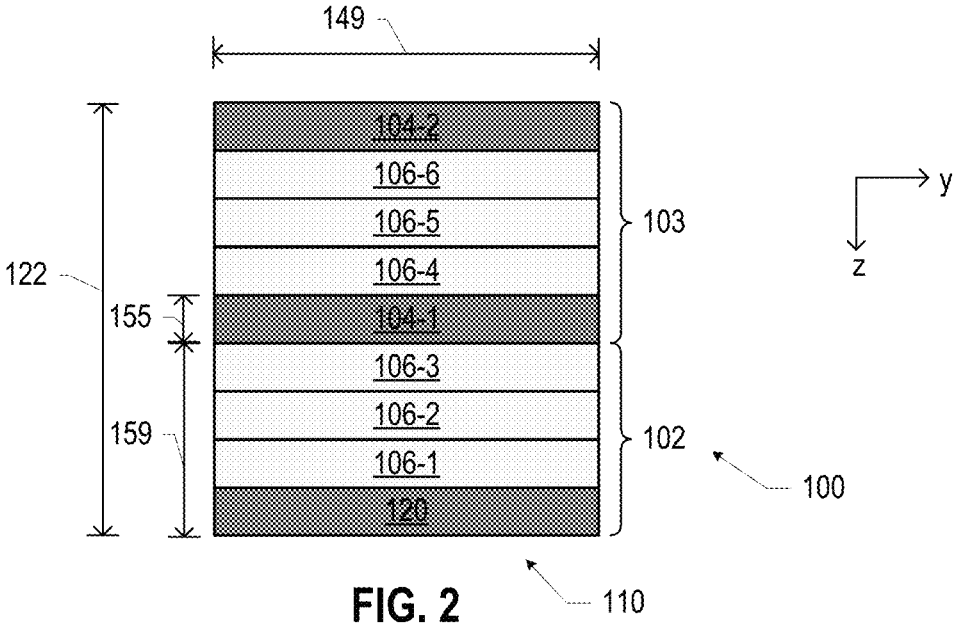
FIG. 2 is a generalized representation of a side view of a portion of an example antenna board, in accordance with various embodiments.

FIG. 2 is a generalized representation of a side view of an example antenna board 100, in accordance with various embodiments. An antenna board 100 may include a ground plane substrate 102 and one or more antenna patches 104. FIG. 2 illustrates two antenna patches 104-1 and 104-2, with the antenna patch 104-1 disposed between the antenna patch 104-2 and the ground plane substrate 102, but an antenna board 100 may include one antenna patch 104 (e.g., as discussed below with reference to FIGS. 3-5) or more than two antenna patches 104 arranged in any desired manner. The ground plane substrate 102 may include a ground plane 120 for the antenna patches 104 of the antenna board 100, and may also include conductive pathways (e.g., provided by conductive vias and lines through one or more dielectric materials, not shown in FIG. 2). The ground plane 120 may be part of an antenna feed structure 118 that may include further feed portions 123 (not shown in FIG. 2, but discussed further below). Generally, a feed structure 118 in an antenna board 100 may be driven by electromagnetic signals during peration, and may directly or indirectly drive one or more antenna patches 104. In some embodiments, at least a portion of the ground plane substrate 102 may be fabricated using PCB technology, and may include between two and eight PCB layers.

The ground plane substrate 102 may include a ground plane 120 and one or more permittivity regions 106 between the ground plane 120 and the antenna patch 104 closest to the ground plane 120. In the embodiment of FIG. 2, that antenna patch 104 is the antenna patch 104-1. Different permittivity regions 106 may have different dielectric constants (e.g., due to different material compositions). In FIG. 2, three different permittivity regions 106-1, 106-2, and 106-3 are illustrated in the ground plane substrate 102, but a ground plane substrate 102 may include more or fewer permittivity regions 106 between the ground plane 120 and the antenna patch 104-1. A number of examples of different ground plane substrates 102 including various numbers and kinds of permittivity regions 106 are discussed herein. Although the ground plane 120 is shown as disposed at the bottom face 110 of the ground plane substrate 102, the ground plane substrate 102 may include more layers and structures "below" the ground plane 120; the ground plane 120 is shown at the bottom face 110 for ease of illustration in various ones of the accompanying figures, but other metal layers may be present between the ground plane 120 and the physical bottom face 110 of the ground plane substrate 102.

Conductive structures in an antenna board 100 (e.g., the ground plane 120, the feed structures(s) 118, the antenna patch(es) 104, etc.) may be formed of any suitable conductive material (e.g., a metal, such as copper). A dielectric material, such as a solid dielectric material or air, may be disposed around various ones of the conductive structures. Any suitable solid dielectric material may be used (e.g., a laminate material). In some embodiments, the dielectric material may be an insulating material used in package substrate technologies, such as an organic dielectric material, a fire retardant grade 4 material (FR-4), bismaleimide triazine (BT) resin, ceramic materials, polyimide materials, glass reinforced epoxy matrix materials, or low-k and ultra low-k dielectric (e.g., carbon-doped dielectrics, fluorine-doped dielectrics, porous dielectrics, and organic polymeric dielectrics).

Some or all of the antenna patches 104 in an antenna board 100 may be arranged in an antenna arrangement 103. An antenna arrangement 103 of multiple antenna patches 104 may exhibit higher gain and higher directivity than a single antenna patch 104, and the gain and directivity improvements may increase with the number of antenna patches 104 in the antenna arrangement 103. When an antenna arrangement 103 includes multiple antenna patches 104, different antenna patches 104 in an antenna arrangement 103 may be separated by one or more permittivity regions 106. In FIG. 2, three different permittivity regions 106-4, 106-5, and 106-6 are illustrated in the antenna arrangement 103, but an antenna arrangement 103 may include more or fewer permittivity regions 106 between adjacent antenna patches 104. In embodiments in which an antenna arrangement 103 includes more than two antenna patches 104, any adjacent pair of antenna patches 104 in the antenna arrangement 103 may be separated by one or more permittivity regions (e.g., in accordance with any of the embodiments discussed herein with reference to the antenna patches 104-1 and 104-2). A number of examples of different antenna arrangements 103 including various numbers and kinds of permittivity regions 106 are discussed herein. Any of the antenna arrangements 103 of the accompanying figures may be included in an antenna board 100 with any of the ground plane substrates 102 disclosed herein.

In some of the embodiments disclosed herein, one of the permittivity regions 106-1, 106-2, or 106-3 may include air (i.e., an air cavity 112, shown in various of the accompanying drawings, may be present between the antenna patch 104-1 and the ground plane 120); additionally or alternatively, in some embodiments, one of the permittivity regions 106-4, 106-5, and 106-6 may include air (i.e., an air cavity 112, shown in various of the accompanying drawings, may be present between the antenna patch 104-1 and the antenna patch 104-2).

Although a single antenna arrangement 103 of antenna patches 104 is depicted in FIG. 2 (and others of the accompanying drawings), this is simply illustrative, and an antenna board 100 may include more than one antenna arrangement 103 of antenna patches 104 (e.g., arranged in an array at a face of the ground plane substrate 102). For example, an antenna board 100 may an antenna arrangement 103 with four stacks of antenna patches 104 (e.g., arranged in a linear array), eight stacks (e.g., arranged in one linear array, or two linear arrays), sixteen stacks (e.g., arranged in a 4×4 array), or thirty-two stacks (e.g., arranged in two 4×4 arrays).

The dimensions of the antenna boards 100 disclosed herein may take any suitable values. For example, in some embodiments, a thickness 159 of the ground plane substrate 102 may be less than 1 millimeter (e.g., between 0.1 millimeters and 0.5 millimeters) for communications in the 20 gigahertz to 40 gigahertz range. In some embodiments, a thickness 155 of an antenna patch 104 may be less than a quarter of the wavelength of the center frequency to be transmitted/received. For example, a thickness 155 of an antenna patch 104 may be less than 1 millimeter (e.g., between 0.2 millimeters and 0.7 millimeters, or between 30 microns and 60 microns). In some embodiments, a lateral dimension 153 of an antenna board 100 may be between 2 millimeters and 6 millimeters (e.g., for communications in the 20 gigahertz to 40 gigahertz range). In some embodiments, a lateral dimension 149 of an antenna patch 104 may be less than half of the wavelength of the center frequency to be transmitted/received. For example, for 28 gigahertz communication, the dimension 149 (e.g., a diameter or edge length) may be between 2.5 millimeters and 5 millimeters. For 39 gigahertz communication, the dimension 149 may be between 1.5 millimeters and 3.5 millimeters. In some embodiments, a thickness 122 of the antenna board 100 may be between 500 microns and 2 millimeters (e.g., between 700 microns and 1 millimeter). In some embodiments, the thickness of a metal layer in an ground plane substrate 102 may be between 5 microns and 50 microns (e.g., between 5 microns and 20 microns, between 10 microns and 20 microns, or approximately 15 microns). In some embodiments, the thickness of a dielectric material between adjacent metal layers in an ground plane substrate 102 may be between 50 microns and 200 microns (e.g., between 60 microns and 100 microns, between 70 microns and 110 microns, approximately 80 microns, approximately 90 microns, or approximately 100 microns).

Figure 3:
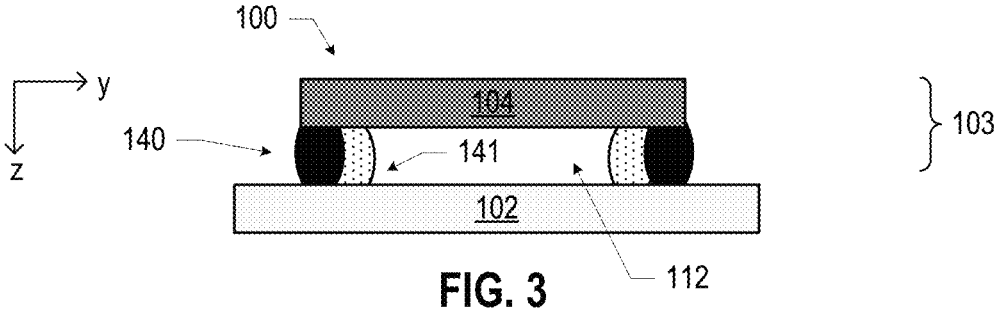
FIGS. 3-4 are side, cross-sectional views of example antenna boards, in accordance with various embodiments.
Figure 4:
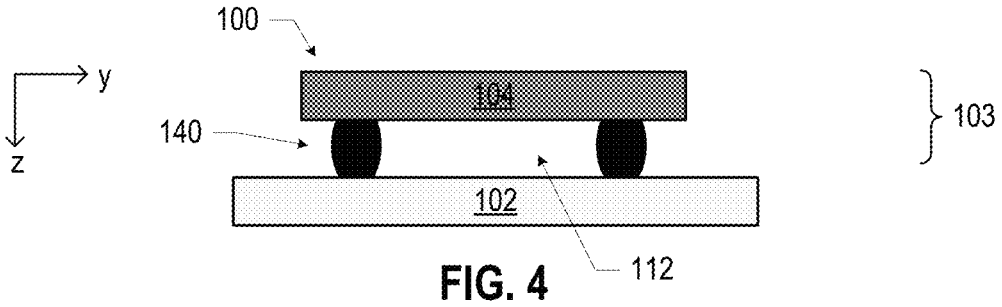

In some embodiments, an antenna patch 104 may be coupled to other structures in an antenna board 100 via solder. For example, FIGS. 3 and 4 illustrate antenna boards 100 including antenna arrangements 103 having a single antenna patch 104 coupled to a ground plane substrate 102 via solder 140. The solder 140 (which may be, for example, solder balls or bumps) may be located proximate to the periphery of the antenna patch 104 (e.g., as illustrated in FIG. 3) or located at an interior of the antenna patch 104 (e.g., as illustrated in FIG. 4). The height of the solder 140 may control the distance between the antenna patch 104 and the ground plane substrate 102. The height of the solder 140 may be controlled with high accuracy (e.g., between 100 microns and 500 microns). In some embodiments, the solder 140 included in any of the embodiments disclosed herein may have a core that includes a non-solder material. For example, the solder 140 may have a core that includes copper or plastic. Using a solder 140 with a non-solder core that has a higher melting point than the solder itself may improve the controllability of the height of the solder 140 and may mitigate the risk of deformation of the solder 140 during manufacturing. In the embodiments of FIGS. 3 and 4 (and others of the accompanying drawings), different permittivity regions 106 are present in both the z- and y-directions. For example, an air cavity 112 is present between the antenna patch 104 and the ground plane substrate 102 proximate to the center of the antenna patch 104 (providing a uniform permittivity region 106), but the volume between the antenna patch 104 and the ground plane substrate 102 that is occupied by solder 140 provides a different permittivity region 106 (one that itself may include multiple permittivity regions 106 when, for example, the solder 140 has a non-solder core). In embodiments in which solder is present, other materials, such as a solder resist, may be present but are not shown. In any of the embodiments disclosed herein, thermal compression bonding (TCB) with solder 140 and/or adhesive 141 (discussed below) may be used to attach various structures together. Any of the air cavities 112 disclosed herein may have any suitable height (in the z-direction). For example, an air cavity 112 may have a height between 50 microns and 500 microns.

Various ones of the accompanying drawings illustrate solder 140 in contact with an antenna patch 104. In some embodiments, the solder 140 may be part of a feed structure 118 in that electrical signals provided to the antenna patch 104 through the solder 140 are used to feed the antenna patch 104 during operation. In other embodiments, the solder 140 may provide a purely mechanical function, and feed structures 118 that do not include the solder 140 (e.g., indirect feed structures 118, like that illustrated in FIG. 14) may be used.

Figure 5A:
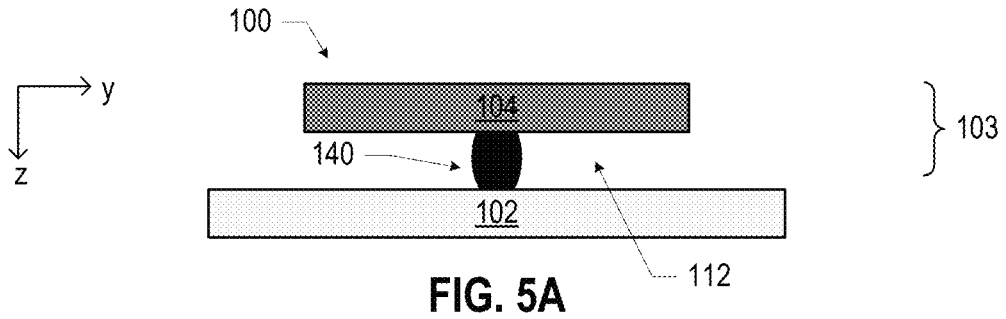
FIGS. 5A and 5B are various views of an example antenna board, in accordance with various embodiments.
Figure 5B:
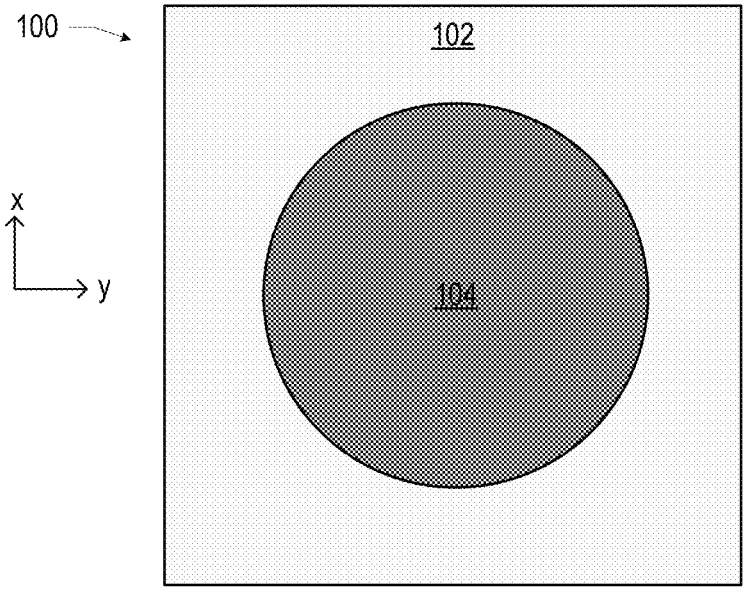

Any of the antenna patches 104 included in any of the antenna boards 100 disclosed herein may have any suitable shape. For example, in some embodiments, an antenna patch 104 may have a rectangular footprint. In other embodiments, an antenna patch 104 may have a circular footprint. For example, FIG. 5 illustrates an embodiment in which an antenna patch 104 has a circular footprint; FIG. 5A is a side, cross-sectional view, while FIG. 5B is a top view. In the embodiment of FIG. 5, the antenna patch 104 is coupled to the ground plane substrate 102 by solder 140 (e.g., with a non-solder core) located at the center of the antenna patch 104; in other embodiments, one or more portions of solder 140 may be used to couple the antenna patch 104 to the ground plane substrate 102 in other locations. In the embodiment of FIG. 5, an air cavity 112 is present between the antenna patch 104 and the ground plane substrate 102 proximate to the periphery of the antenna patch 104 (providing a uniform permittivity region 106), but the volume between the antenna patch 104 and the ground plane substrate 102 that is occupied by solder 140 provides a different permittivity region 106 (one that itself may include multiple permittivity regions 106 when, for example, the solder 140 has a non-solder core). The "table-like" structure illustrated in FIG. 5 may also be used with antenna patches 104 with non-circular footprints (e.g., antenna patches 104 with rectangular footprints). Although the antenna patches 104 illustrated in the accompanying drawings are "solid," an antenna patch 104 may have one or more apertures therein, and these apertures may have any desired shape. For example, in some embodiments, an antenna patch 104 may have a rectangular aperture therein. In some embodiments, an antenna patch 104 may have a slot or cross-shaped aperture therein.

Figure 6:
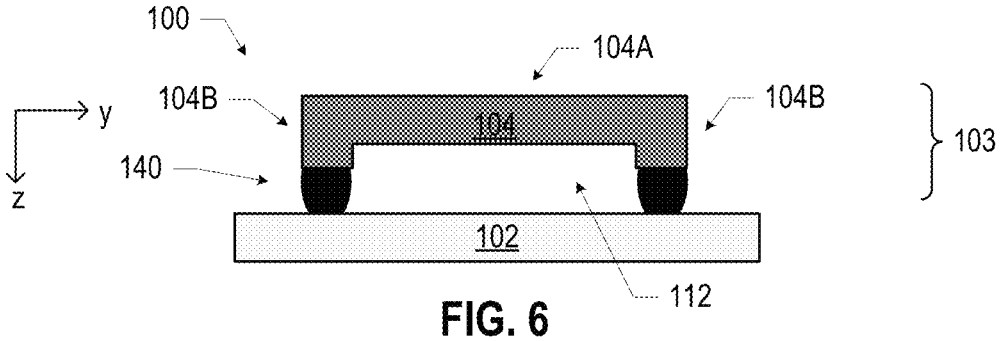
FIG. 6 is a side, cross-sectional view of an example antenna board, in accordance with various embodiments.

In some embodiments, an antenna patch 104 may be substantially planar, while in other embodiments, an antenna patch 104 may have three-dimensional contours. For example, FIGS. 3-5 illustrate examples of planar antenna patches 104, while FIG. 6 illustrates an antenna board 100 including a non-planar antenna patch 104 coupled to a ground plane substrate 102. The non-planar antenna patch 104 of FIG. 6 includes a central portion 104A and one or more leg portions 104B that extend perpendicularly away from the central portion 104A towards the ground plane substrate 102. In some embodiments, the antenna patch 104 of FIG. 6 (or other non-planar antenna patches 104) may be stamped from sheet metal into a desired shape. As illustrated in FIG. 6, the leg portions 104B may be coupled to the ground plane substrate 102 by solder 140. The leg portions 104B, together with the solder 140, may control the spacing between the antenna patch 104 of FIG. 6 and the ground plane substrate 102. An air cavity 112 may be present between the central portion 104A of the antenna patch 104 and the ground plane substrate 102, providing a permittivity region 106.

In some embodiments, the antenna patches 104 may be electrically coupled to the ground plane substrate 102 by electrically conductive material pathways through the ground plane substrate 102 that make conductive contact with electrically conductive material of the antenna patches 104, while in other embodiments, the antenna patches 104 may be mechanically coupled to the ground plane substrate 102 but may not be in contact with an electrically conductive material pathway through the ground plane substrate 102. For example, FIG. 3 illustrates an embodiment in which an antenna patch 104 is coupled to the ground plane substrate 102 by solder 140, and also by an adhesive 141. The adhesive 141 may provide mechanical support to the antenna patch 104, and may further control the distance between the antenna patch 104 and the ground plane substrate 102 during manufacturing and handling. Although adhesive 141 is omitted from many of the accompanying drawings for ease of illustration, any of the antenna boards 100 disclosed herein may include adhesive 141 between any suitable components (e.g., between a ground plane substrate 102 and an antenna patch 104, between different antenna patches 104, etc.). Although the presence of the adhesive 141 provides another permittivity region 106 (which may perturb performance of the antenna patch 104) between the antenna patch 104 and the ground plane substrate 102, the mechanical advantages of the use of the adhesive 141 may outweigh a decrease in performance of the antenna board 100. Generally, any of the embodiments disclosed herein in which the ground plane substrate 102 is not coupled to one or more of the antenna patches 104 by an electrically conductive material pathway may be modified to include such a pathway, and vice versa.

Figure 7A:
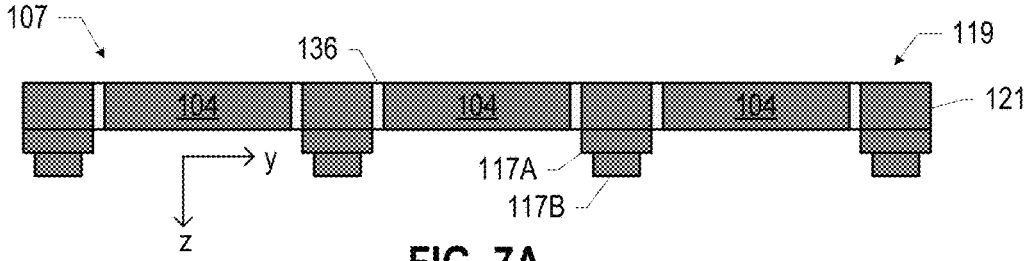
FIGS. 7A and 7B, 8A and 8B, and 9A and 9B are various views of example structures that may be included in an antenna board, in accordance with various embodiments.
Figure 7B:
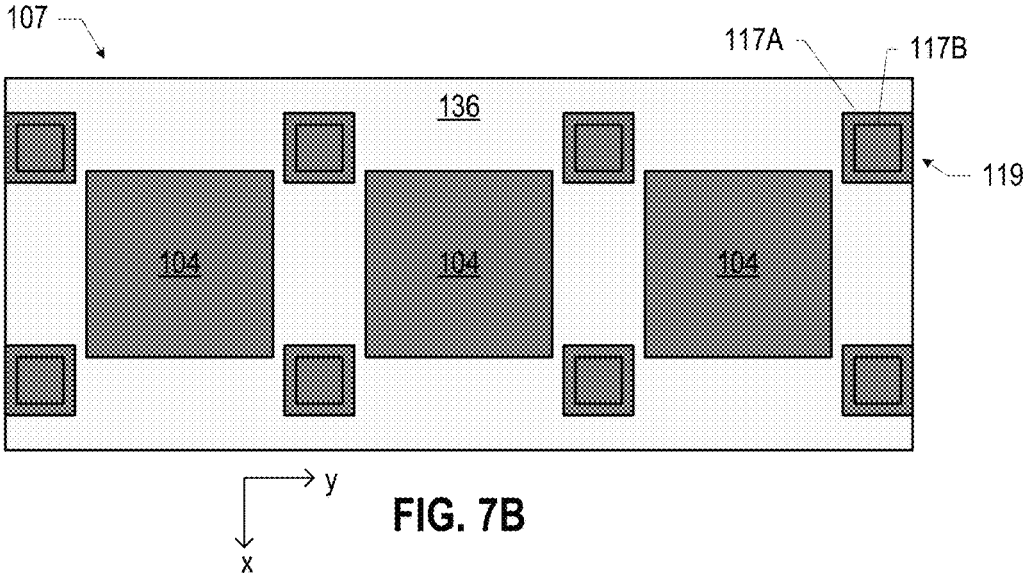

In some embodiments, an antenna board 100 may include multiple coplanar antenna patches 104. For example, FIG. 7 illustrates a structure 107 having multiple coplanar antenna patches 104 that may be included in an antenna arrangement 103 (e.g., as discussed below with reference to FIG. 10). FIG. 7A is a side, cross-sectional view, while FIG. 7B is a bottom view. Although FIG. 7 illustrates three antenna patches 104 arranged in a linear array, any of the structures 107 disclosed herein may include any desired arrangement of antenna patches 104 (e.g., a linear array, a two-dimensional array, another arrangement, etc.). The structure 107 of FIG. 7 includes three antenna patches 104 embedded in a support board 136. A support board 136 may have any suitable structure; for example, in some embodiments, a support board 136 may include a dielectric material (e.g., any of the dielectric materials disclosed herein), and/or may be a PCB or a non-conductive plastic structure. In some embodiments, the antenna patch 104 may be a conductive (e.g., metal) layer in the support board 136, and thus at least partially embedded in the support board 136. In some embodiments, the antenna patch 104 may be surface mounted (e.g., via solder), glued, laminated, or otherwise coupled to a face of the support board 136 (not shown).

The structure 107 may include one or more pedestals 119 at least partially embedded in the dielectric material of the support board 136. The pedestals 119 may have a first portion 121 that is coplanar with the antenna patches 104 (e.g., embedded in the support board 136) and a second portion 117 that extends from the face of the support board 136, as shown. In the embodiment of FIG. 7, the second portion 117 of the pedestals 119 has two sub-portions, 117A and 117B, with different widths; the width of the portion 117B may be less than the width of the portion 117A. In other embodiments, the second portion 117 of the pedestals 119 may have only a single width, or may have more than two sub-portions of varying widths. The height of the second portion 117 (in the z-direction) may be any suitable value; for example, in some embodiments, the height of the second portion 117 may be between 14 microns and 40 microns.

FIG. 7B illustrates the pedestals 119 as having substantially square footprints, and located proximate to the corners of the rectangular antenna patches 104, but the pedestals 119 and/or the antenna patches 104 may have footprints of other shapes, and the pedestals 119 may be differently distributed around the antenna patches 104. In some embodiments, the pedestals 119 may be separated from the antenna patches 104 by an intervening dielectric material of the support board 136, and thus may not be in conductive contact with the antenna patches 104. The pedestals 119 may, in some embodiments, provide shielding around the antenna patches 104, and may also serve to couple the structure 107 to a ground plane substrate 102 or other portions of an antenna arrangement 103 (e.g., as discussed below with reference to FIG. 10) so that the antenna patches 104 are spaced at a controlled distance from the other structures. Shields may reduce surface waves that cause undesirable coupling and degrade the impedance bandwidth of the antenna and increase the reflection level during beamforming, improving performance. Surface waves may also be responsible for side lobes and null angle limits in beam steering, and thus mitigating surface waves may improve these properties. For example, for boresight radiation antennas, the null angle limits are the angles at which the active scattering parameters (S11) of the antenna array start to degrade quickly due to the high input impedance seen by the antenna feed structures of the antennas in the array; suppressing surface waves for such antennas may benefit the antenna impedance bandwidth in an active scanning array and may enable a wider scanning angle for the array.

Figure 8A:
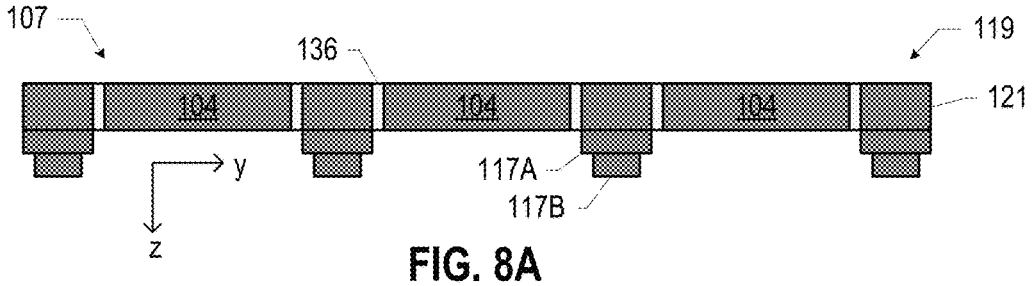
Figure 8B:
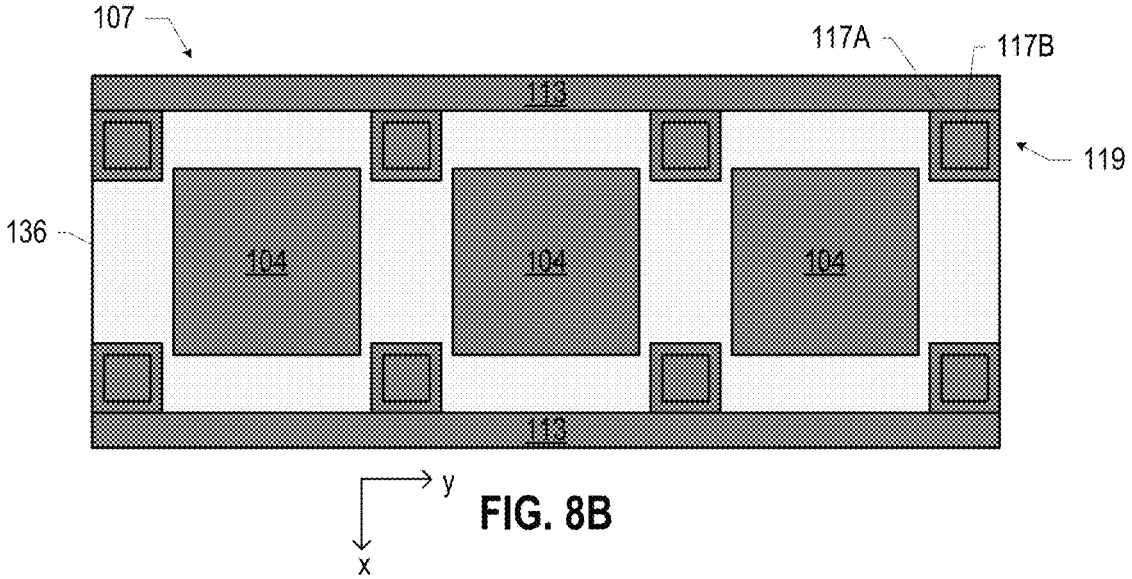

FIG. 8 illustrates another structure 107 including multiple antenna patches 104 and multiple pedestals 119; FIG. 8A is a side, cross-sectional view, while FIG. 8B is a bottom view. The elements of the structure 107 of FIG. 8 that are shared with the structure 107 of FIG. 7 may take any of the forms discussed above with reference to FIG. 7, and for ease of illustration, are not discussed again with reference to FIG. 8. Relative to the structure 107 of FIG. 7, the structure 107 of FIG. 8 includes peripheral portions 113 of conductive material (e.g., copper or another metal) outside the array of antenna patches 104. In some embodiments, the peripheral portions 113 may be proximate to edges of the support board 136. In some embodiments, the peripheral portions 113 may be embedded in the dielectric material of the support board 136 (e.g., as a conductive layer in the support board 136) and/or may be disposed at a surface of the support board 136. As shown in FIG. 8, the pedestals 119 may be in physical and conductive contact with the peripheral portions 113. In some embodiments, the peripheral portions 113 and the pedestals 119 may together provide shielding to the antenna patches 104.

Figure 9A:
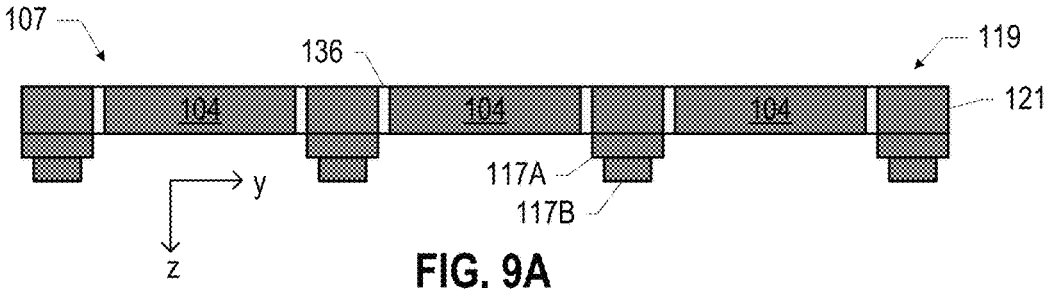
Figure 9B:
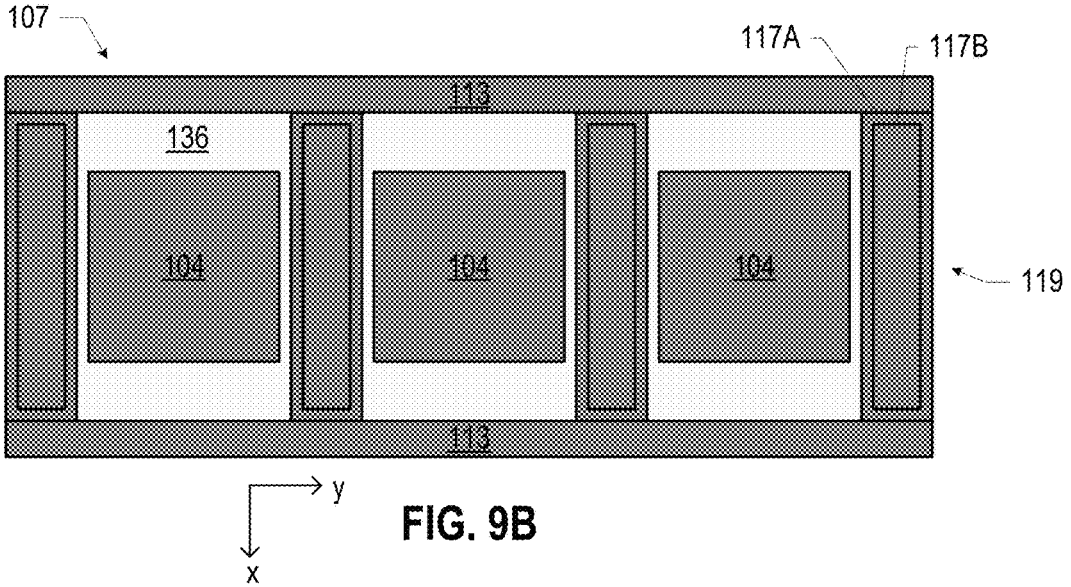

FIG. 9 illustrates another structure 107 including multiple antenna patches 104 and multiple pedestals 119; FIG. 9A is a side, cross-sectional view, while FIG. 9B is a bottom view. The elements of the structure 107 of FIG. 9 that are shared with the structures 107 of FIGS. 7 and 8 may take any of the forms discussed above with reference to FIG. 7 and/or FIG. 8, and for ease of illustration, are not discussed again with reference to FIG. 9. Relative to the structure 107 of FIG. 8, the pedestals 119 of the structure 107 of FIG. 9 have rectangular footprints that extend between adjacent pairs of antenna patches 104. Further, the pedestals 119 of the structure 107 of FIG. 9 may also make conductive contact with the peripheral portions 113 of conductive material. As discussed above with reference to FIG. 8, in some embodiments, the peripheral portions 113 and the pedestals 119 may together provide shielding to the antenna patches 104.

Figure 10:
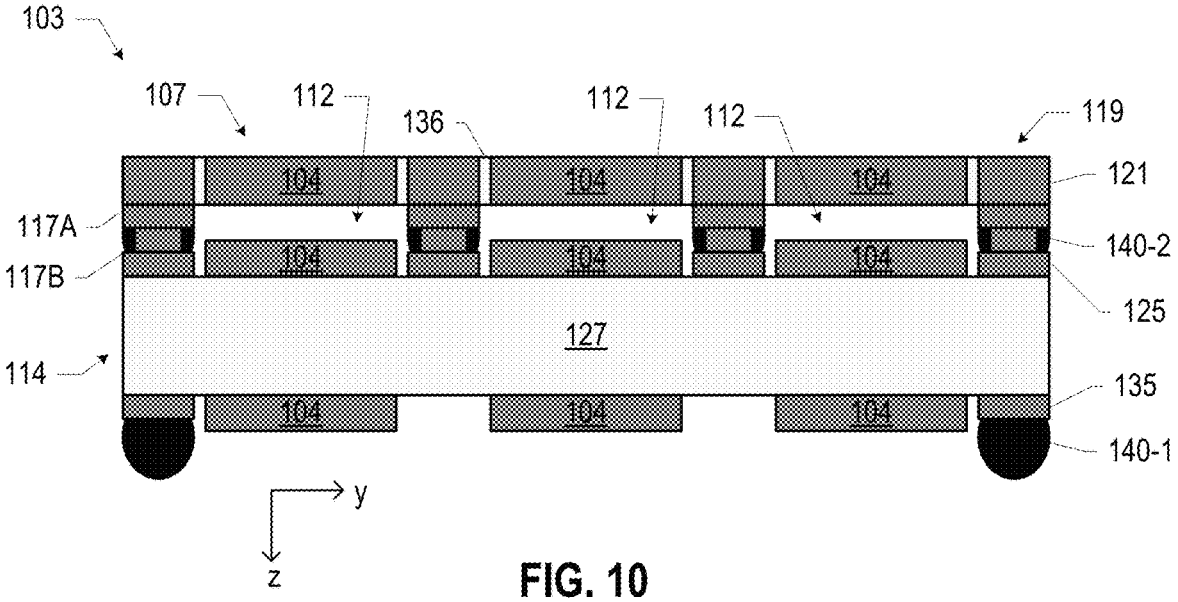
FIG. 10 is a side, cross-sectional view of an example antenna board, in accordance with various embodiments.

Any of the structures 107 of FIGS. 7-9 may be included in an antenna arrangement 103 in an antenna board 100. For example, FIG. 10 illustrates an antenna arrangement 103 including a structure 107 (which may take any of the forms discussed above with reference to FIGS. 7-9) coupled to a structure 114. The structure 114 may include a support board 127 (which may take the form of any of the embodiments of the support board 136 disclosed herein) and may have antenna patches 104 disposed on opposing faces of the support board 136. The structure 107 may be coupled to the structure 114 by solder 140-2 between the pedestals 119 of the structure 107 and conductive contacts 125 of the structure 114. As used herein, a "conductive contact" may refer to a portion of conductive material (e.g., metal) serving as an electrical interface between different components; conductive contacts may be recessed in, flush with, or extending away from a surface of a component, and may take any suitable form (e.g., a conductive pad or socket). In some embodiments, the structure 114 may include conductive contacts 135 at the opposite face of the support board 127; solder 140-1 on these conductive contacts 135 may be used to couple the antenna arrangement 103 to a ground plane substrate 102 (not shown). The antenna arrangement 103 of FIG. 10 may thus include three tiers of antenna patches 104, with the first tier separated from the second tier by the intervening material of the support board 127, and the second tier separated from the third tier by air cavities 112. In some embodiments, the distance between antenna patches 104 in different tiers may be between 50 microns and 200 microns (e.g., between 100 microns and 150 microns).

Figure 11A:
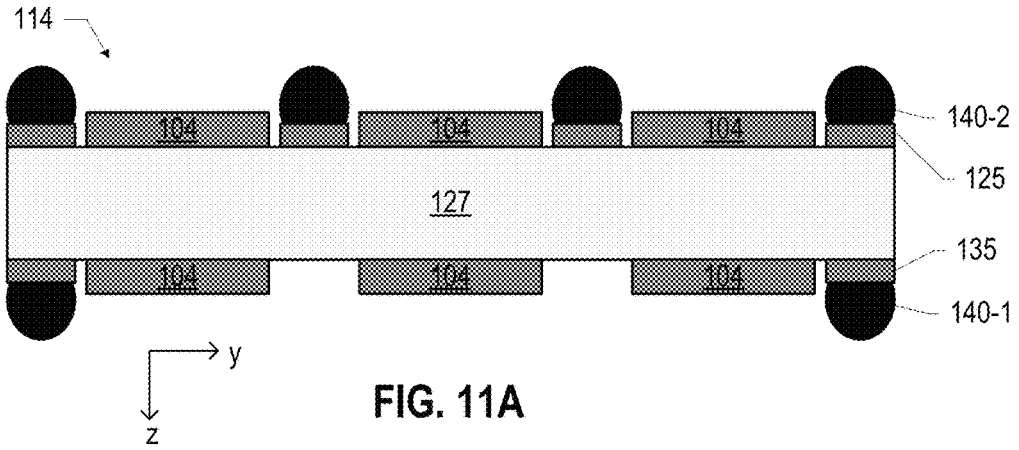
FIGS. 11A and 11B illustrate various stages in an example process for manufacturing the antenna board of FIG. 10, in accordance with various embodiments.
Figure 11B:
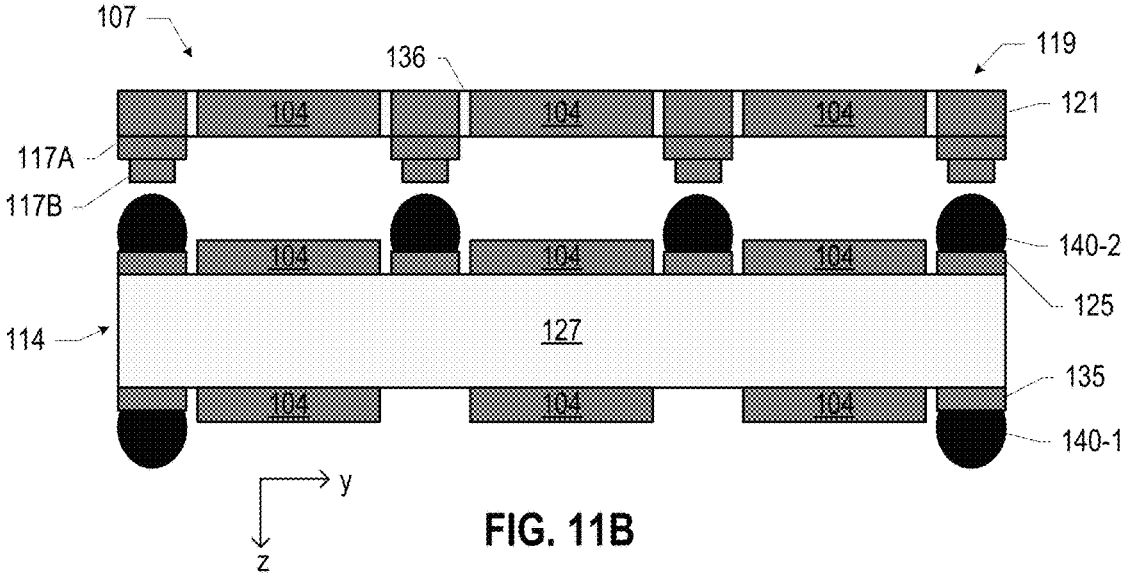

The antenna arrangement 103 of FIG. 10 may be manufactured using any suitable technique. For example, FIGS. 11A and 11B illustrate example stages in a process for manufacturing the antenna arrangement 103 of FIG. 10 (or other antenna arrangements 103 having similar structure). FIG. 11A illustrates the structure 114 having solder 140-2 disposed on the conductive contacts 125; the structure 114 may be manufactured using a PCB process, for example, and the solder 140-2 may be dispensed using any suitable technique (e.g., as bumps). Utilizing portions of solder 140-2 with a smaller height may mitigate potential variation in the spacing between the structure 114 and the structure 107 (discussed below) relative to embodiments in which portions of solder 140-2 with a larger height (e.g., ball grid array (BGA) balls) are used.

FIG. 11B illustrates the structure 107 being brought into proximity to the structure 114 of FIG. 11A so that the pedestals 119 of the structure 107 align with the solder 140-2/conductive contacts 125; a reflow process may be performed to melt the solder 140-2 and couple the pedestals 119 to the conductive contacts 125, forming the antenna arrangement 103 of FIG. 10. In some embodiments, the structure 107 may be manufactured using a molded interconnect system ball grid array (MISBGA) process in which no mold material is needed for the manufacture of the second portion 117 (the second layer in the MISBGA process).

Figure 12:
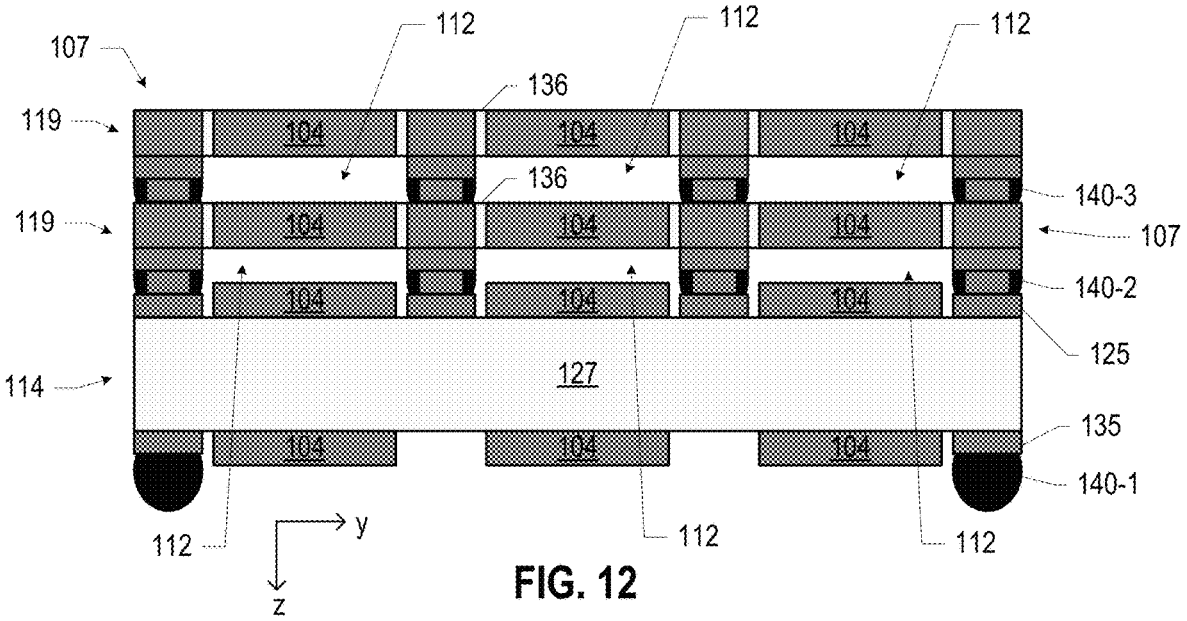
FIG. 12 is a side, cross-sectional view of an example antenna board, in accordance with various embodiments.

The operations illustrated in FIG. 11 may be repeated as desired to couple any number of structures 107 to a structure 114. For example, FIG. 12 illustrates an antenna arrangement 103 including two structures 107 coupled to the structure 114, with one structure 107 between the other structure 107 and the structure 114. In this manner, an antenna arrangement 103 including any number of tiers of antenna patches 104 (and intervening air cavities 112) may be formed. Although various ones of the examples of antenna arrangements 103 that include multiple tiers of antenna patches 104 may illustrate corresponding antenna patches 104 in different tiers as having their centers aligned (e.g., so that one antenna patch 104 is directly above another), this need not be the case; multiple antenna patches 104 in different tiers an antenna arrangement 103 may be horizontally offset from each other, as desired.

In some embodiments, the structure 114 may include a ground plane 120 and other elements of a feed structure 118, and thus may serve as the ground plane substrate 102. In some such embodiments, the antenna patches 104 on the same face of the support board 127 as the conductive contacts 135 may be omitted.

Figure 13A:
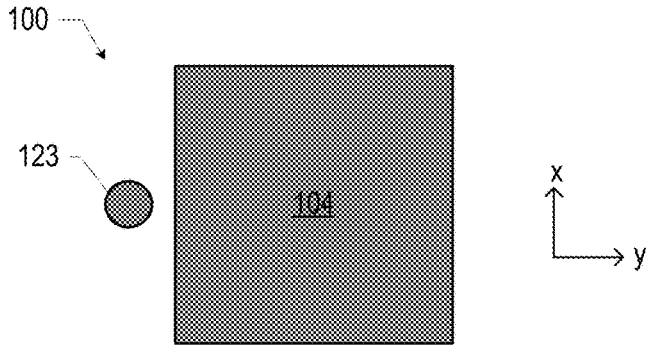
FIGS. 13A and 13B are various views of an example arrangement of an antenna patch and a feed structure, in accordance with various embodiments.
Figure 13B:
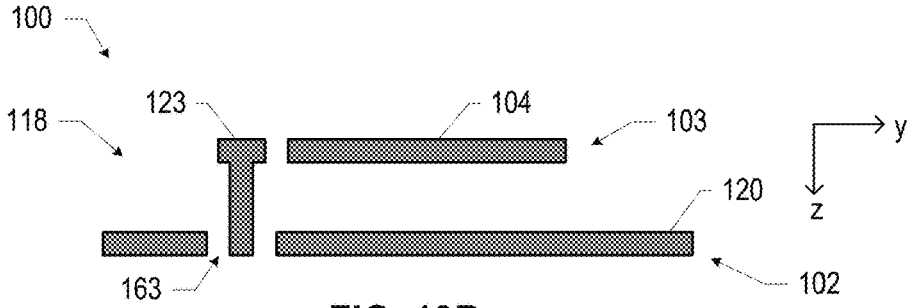

The feed structure 118 included in an antenna board 100 may take any suitable form. For example, FIG. 13 illustrates a feed structure 118 that may be included in any of the antenna boards 100 disclosed herein; FIG. 13A is a top view, and FIG. 13B is a side, cross-sectional view. The feed structure 118 of FIG. 13 includes a ground plane 120 and a feed portion 123 that extends perpendicular to the ground plane 120 towards the plane of the antenna patch 104. One end of the feed portion 123 may be disposed in an opening 163 in the ground plane 120, and the other end of the feed portion 123 may be coplanar with the antenna patch 104. This other end of the feed portion 123 may be "to the side" of the antenna patch 104, as shown, and in some embodiments, the width of the feed portion 123 proximate to the antenna patch 104 may be greater than the width of the remainder of the feed portion 123. The feed portion 123 may not be in contact with the antenna patch 104, but may instead feed the antenna patch 104 indirectly during operation.

Figure 14A:
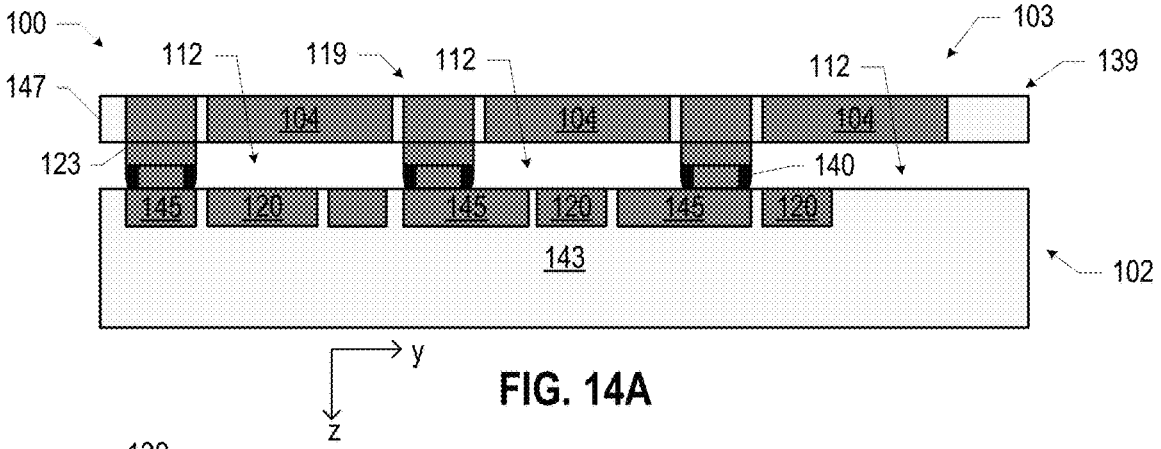
FIGS. 14A and 14B are various views of an example antenna board including the arrangement of FIG. 13, in accordance with various embodiments.
Figure 14B:
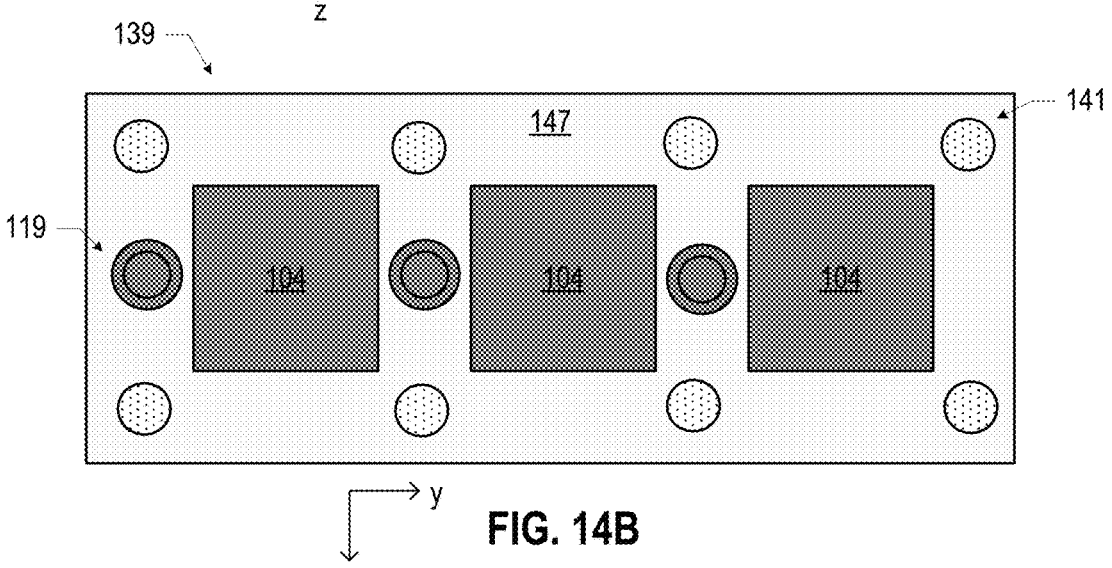

FIG. 14 illustrates an example antenna board 100 including a structure 139 and multiple ones of the feed structures 118 of FIG. 13. FIG. 14A is a side, cross-sectional view, while FIG. 14B is a bottom view of the structure 139 of the antenna board 100. In the antenna board 100 of FIG. 14, a ground plane substrate 102 includes a ground plane 120 at a top face of a support board 143 (which may take the form of any of the support boards disclosed herein). Conductive contacts 145 may also be disposed at the top face of the support board 143. In some embodiments, the conductive contacts 145 may have a circular footprint. A structure 139 including pedestals 119 and antenna patches 104 in a support board 147 (which may take the form of any of the support boards disclosed herein) may have a similar structure to the structures 107 disclosed herein, but the pedestals 119 may have a circular footprint and may be located proximate to a center of a side face of an associated antenna patch 104, as shown in FIG. 14B. The pedestals 119 of the structure 139 may be coupled to the conductive contacts 145 by solder 140; together, the pedestals 119 and the conductive contacts 145 may provide the feed portions 123. The antenna board 100 may further include portions of adhesive 141 that extend from the structure 139 to the ground plane substrate 102 to provide mechanical support; although FIG. 14 illustrates a particular number and arrangement of portions of adhesive 141, adhesive 141 may be arranged in any desired manner (or omitted).

Figure 15:
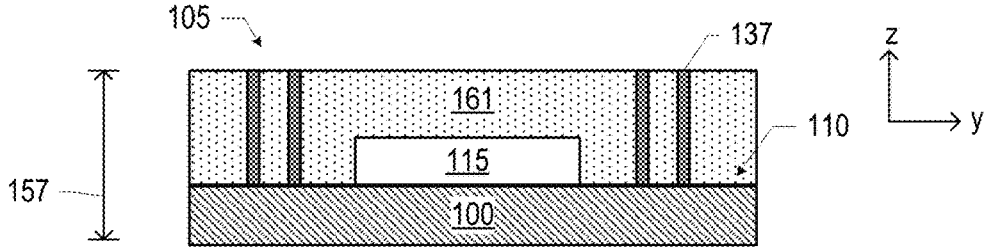
FIG. 15 is a side, cross-sectional view of an example antenna module, in accordance with various embodiments.

In some embodiments, an antenna board 100 may be part of an antenna module. For example, FIG. 15 is a side, cross-sectional view of an antenna module 105, in accordance with various embodiments. The antenna module 105 may include an IC package 115 coupled to an antenna board 100. Although a single IC package 115 is illustrated in FIG. 1, an antenna module 105 may include more than one IC package 115 (and/or more than one antenna board 100, as discussed below with reference to FIG. 17). As noted above, the antenna board 100 may include an ground plane substrate 102 (not shown in FIG. 15) having conductive pathways (e.g., provided by conductive vias and lines through one or more dielectric materials) and radio frequency (RF) transmission structures (e.g., feed structures 118) that may enable one or more antenna patches 104 (not shown in FIG. 15) to transmit and receive electromagnetic waves under the control of circuitry in the IC package 115. In some embodiments, the IC package 115 may be coupled to the antenna board 100 by second-level interconnects (not shown, but discussed below with reference to FIG. 16). In some embodiments, an antenna module 105 may include a different IC package 115 for controlling each different antenna patch 104 or antenna arrangement 103; in other embodiments, an antenna module 105 may include one IC package 115 having circuitry to control multiple antenna patches 104 or multiple sets of antenna arrangements 103. In some embodiments, the total z-height 157 of an antenna module 105 may be less than 3 millimeters (e.g., between 2 millimeters and 3 millimeters).

In the embodiment of FIG. 15, a mold compound 161 is shown disposed around the IC package 115, and conductive pillars 137 (e.g., copper pillars) extend from the antenna board 100 through the mold compound 161 and are exposed at the top face of the antenna module 105. The conductive pillars 137 may be in contact with conductive contacts on the face of the antenna board 100 (not shown), and the antenna module 105 may be coupled to another component (e.g., a motherboard) at its top face; electrical signals may be transmitted to/from the IC package 115 from such other component via the conductive pillars 137, conductive pathways in the antenna board 100 (not shown), and second-level interconnects (not shown) between the antenna board 100 and the IC package 115.

In some embodiments, an antenna board 100 and/or an antenna module 105 may include one or more arrays of antenna patches 104 to support multiple communication bands (e.g., dual band operation or tri-band operation). For example, some of the antenna boards 100 and/or antenna modules 105 disclosed herein may support tri-band operation at 28 gigahertz, 39 gigahertz, and 60 gigahertz. Various ones of the antenna boards 100 and/or antenna modules 105 disclosed herein may support tri-band operation at 24.5 gigahertz to 29 gigahertz, 37 gigahertz to 43 gigahertz, and 57 gigahertz to 71 gigahertz. Various ones of the antenna boards 100 and/or antenna modules 105 disclosed herein may support 5G communications and 60 gigahertz communications. Various ones of the antenna boards 100 and/or antenna modules 105 disclosed herein may support 28 gigahertz and 39 gigahertz communications. Various of the antenna boards 100 and/or antenna modules 105 disclosed herein may support millimeter wave communications. Various of the antenna boards 10 and/or antenna modules 105 disclosed herein may support high band frequencies and low band frequencies.

Figure 16:
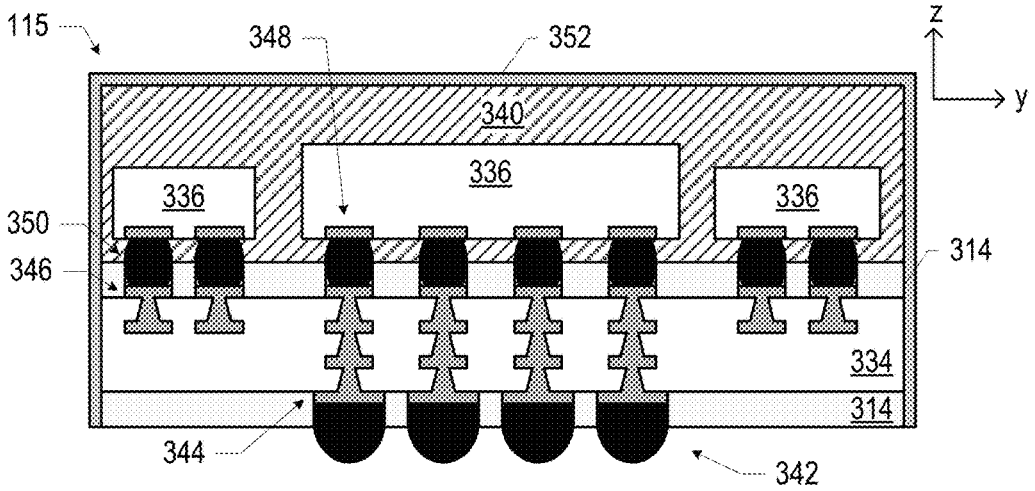
FIG. 16 is a side, cross-sectional view of an example integrated circuit (IC) package that may be included in an antenna module, in accordance with various embodiments.

The IC package 115 included in an antenna module 105 may have any suitable structure. For example, FIG. 16 illustrates an example IC package 115 that may be included in an antenna module 105. The IC package 115 may include a package substrate 334 to which one or more components 336 may be coupled by first-level interconnects 350. In particular, conductive contacts at one face of the package substrate 334 may be coupled to conductive contacts 348 at faces of the components 336 by first-level interconnects 350. The first-level interconnects 350 illustrated in FIG. 16 are solder bumps, but any suitable first-level interconnects 350 may be used. A solder resist 314 may be disposed around the conductive contacts 346. The package substrate 334 may include a dielectric material, and may have conductive pathways (e.g., including conductive vias and lines) extending through the dielectric material between the faces, or between different locations on each face. In some embodiments, the package substrate 334 may have a thickness less than 1 millimeter (e.g., between 0.1 millimeters and 0.5 millimeters). Conductive contacts 344 may be disposed at the other face of the package substrate 334, and second-level interconnects 342 may couple these conductive contacts 344 to the antenna board 100 (not shown) in an antenna module 105. The second-level interconnects 342 illustrated in FIG. 16 are solder balls (e.g., for a ball grid array arrangement), but any suitable second-level interconnects 342 may be used (e.g., pins in a pin grid array arrangement or lands in a land grid array arrangement). A solder resist 314 may be disposed around the conductive contacts 344. In some embodiments, a mold material 340 may be disposed around the components 336 (e.g., between the components 336 and the package substrate 334 as an underfill material). In some embodiments, a thickness of the mold material may be less than 1 millimeter. Example materials that may be used for the mold material 340 include epoxy mold materials, as suitable. In some embodiments, a conformal shield 352 may be disposed around the components 336 and the package substrate 334 to provide electromagnetic shielding for the IC package 115.

The components 336 may include any suitable IC components. In some embodiments, one or more of the components 336 may include a die. For example, one or more of the components 336 may be a RF communication die. In some embodiments, one or more of the components 336 may include a resistor, capacitor (e.g., decoupling capacitors), inductor, DC-DC converter circuitry, or other circuit elements. In some embodiments, the IC package 115 may be a system-in-package (SiP). In some embodiments, the IC package 115 may be a flip chip (FC) chip scale package (CSP). In some embodiments, one or more of the components 336 may include a memory device programmed with instructions to execute beam forming, scanning, and/or codebook functions.

Figure 17:
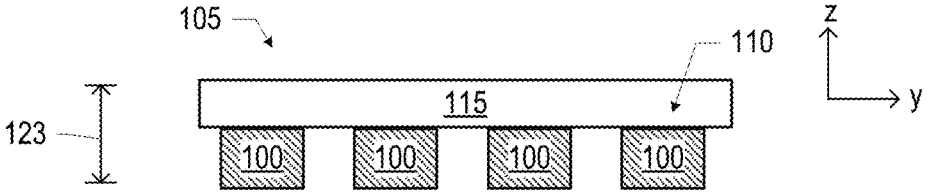
FIG. 17 is a side, cross-sectional view of another example antenna module, in accordance with various embodiments.

As noted above, in some embodiments, an antenna module 105 may include multiple antenna boards 100. For example, FIG. 17 illustrates an embodiment in which multiple antenna boards 100 are coupled to a single IC package 115. In some embodiments, a connector (not shown) may be mounted to one or more of the faces of the IC package 115 of FIG. 17 to enable the antenna module 105 to communicate with other components (e.g., a motherboard). Any suitable connector may be used (e.g., a coaxial connector, a flat cable connector, etc.).

Figure 18:
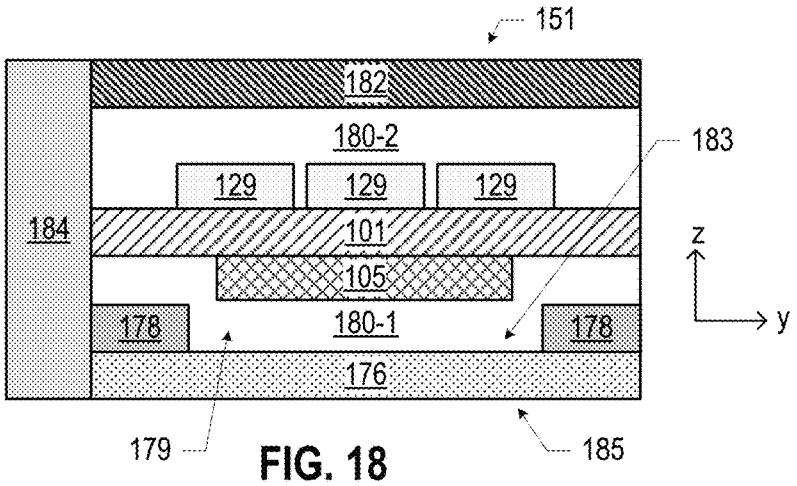
FIG. 18 is a side, cross-sectional view of a portion of an example communication device including an antenna module, in accordance with various embodiments.

The antenna boards 100 and antenna modules 105 disclosed herein may be included in any suitable communication device (e.g., a computing device with wireless communication capability, a wearable device with wireless communication circuitry, etc.). FIG. 18 is a side, cross-sectional view of a portion of a communication device 151 including an antenna module 105, in accordance with various embodiments. In particular, the communication device 151 illustrated in FIG. 18 may be a handheld communication device, such as a smart phone or tablet. The communication device 151 may include a glass or plastic back cover 176 proximate to a metallic or plastic chassis 178. In some embodiments, the chassis 178 may be laminated onto an inner face 183 of the back cover 176 (opposite to an outer face 185 of the back cover 176), or attached to the back cover 176 with an adhesive. In some embodiments, the portion of the chassis 178 adjacent to the back cover 176 may have a thickness between 0.1 millimeters and 0.4 millimeters; in some such embodiments, this portion of the chassis 178 may be formed of metal. In some embodiments, the back cover 176 may have a thickness between 0.3 millimeters and 1.5 millimeters; in some such embodiments, the back cover 176 may be formed of glass. The chassis 178 may include one or more windows 179 that align with antenna patches 104 (not shown) of the antenna module 105 to improve performance.

An air cavity 180-1 may space at least some of the antenna module 105 from the back cover 176. In some embodiments, the height of the air cavity 180-1 may be between 0.5 millimeters and 3 millimeters. The antenna module 105 may be mounted to a face of the circuit board 101 (e.g., a motherboard), and other components 129 (e.g., other IC packages) may be mounted to the opposite face of the circuit board 101. In some embodiments, the circuit board 101 may have a thickness between 0.2 millimeters and 1 millimeter (e.g., between 0.3 millimeters and 0.5 millimeters). Another air cavity 180-2 may be located between the circuit board 101 and a display 182 (e.g., a touch screen display). In some embodiments, the spacing between the antenna patches 104 (not shown) of the antenna module 105 and the back cover 176 may be selected and controlled within tens of microns to achieve desired performance. The air cavity 180-2 may separate the antenna module 105 from the display 182 on the front side of the communication device 151; in some embodiments, the display 182 may have a metal layer proximate to the air cavity 180-2 to draw heat away from the display 182. A metal or plastic housing 184 may provide the "sides" of the communication device 151.

Figure 19:
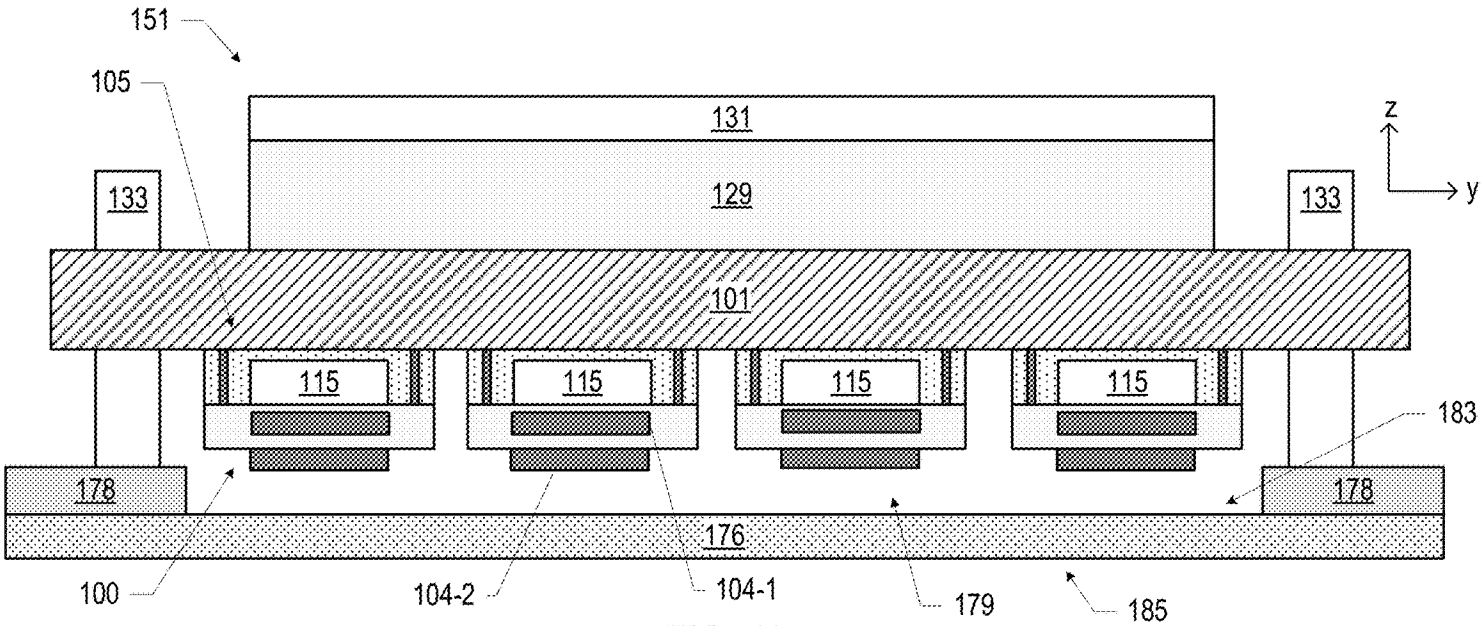
FIG. 19 is a side, cross-sectional view of a portion of an example communication device including an example antenna module, in accordance with various embodiments.

FIG. 19 is a side, cross-sectional view of a portion of an example communication device 151 including an example antenna module 105, in accordance with various embodiments. The example antenna module 105 of FIG. 19 includes two antenna patches 104 arranged in each of four antenna boards 100; the antenna boards 100 are included in antenna modules 105 like the antenna module 105 discussed above with reference to FIG. 15. The antenna modules 105 are coupled to a circuit board 101, which is itself mechanically secured to the chassis 178 by fasteners 133 (e.g., screws). In some embodiments, the fasteners 133 may be spaced apart from the proximate antenna modules 105 by a distance between 1 millimeter and 2 millimeters. A component 129 is disposed on the other face of the circuit board 101, and a heat spreader 131 is disposed on that component 129. The antenna patches 104 are proximate to a window 179 in the chassis 178.

Figure 20:
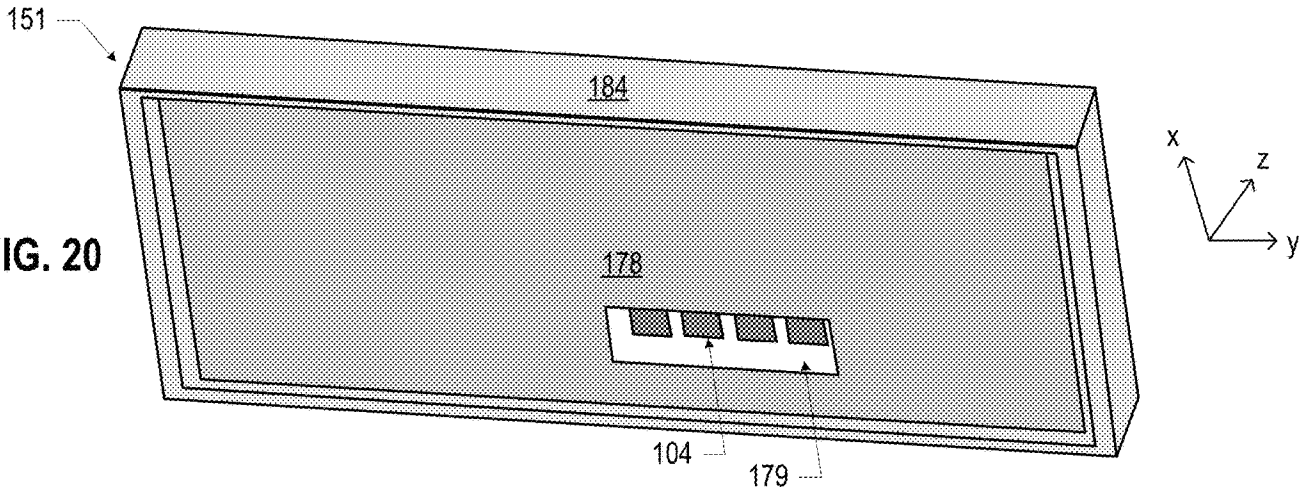
FIG. 20 illustrates an example communication device including antenna patches and a window, in accordance with various embodiments.

A window 179 in a chassis 178 may have any suitable shape, which may influence the near-field region of the antenna patches 104 (e.g., in a metallic chassis 178). For example, FIG. 20 illustrates an example communication device 151 having a rectangular window 179 in the chassis 178; an array of four antenna patches 104 (which may be part of different antenna arrangements 103 in a same antenna board 100, or different antenna boards 100) may be located above the window 179. A chassis 178 may also have non-rectangular windows 179.

Figure 21A:
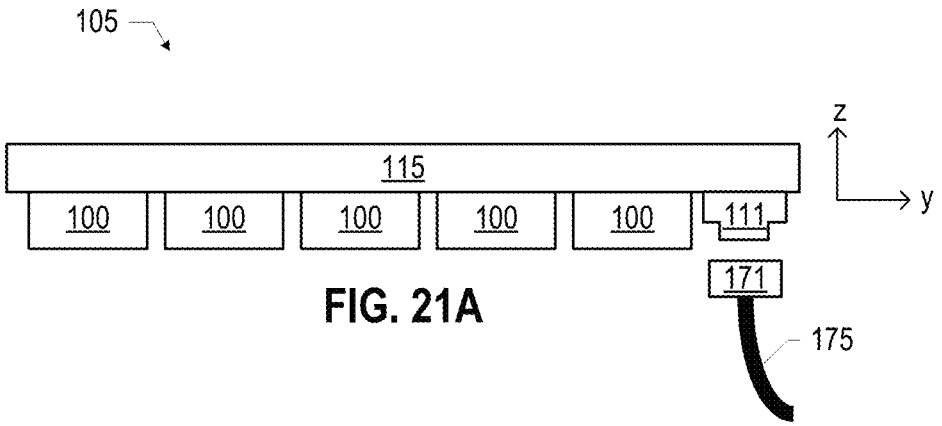
FIGS. 21A-21B are views of an example antenna module, in accordance with various embodiments.
Figure 21B:
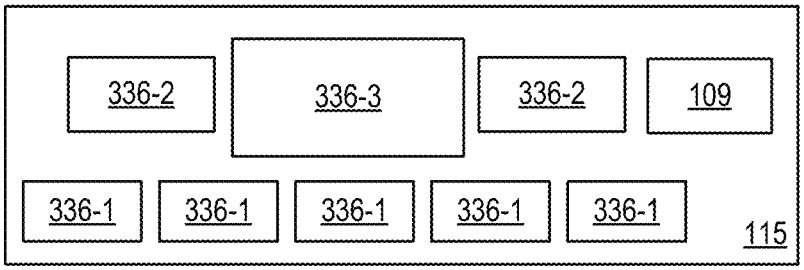
Figure 22:
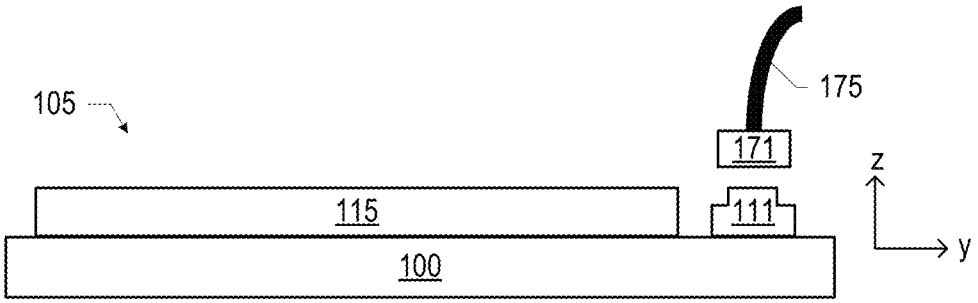
FIGS. 22-23 are side, cross-sectional views of example antenna modules, in accordance with various embodiments.
Figure 23:
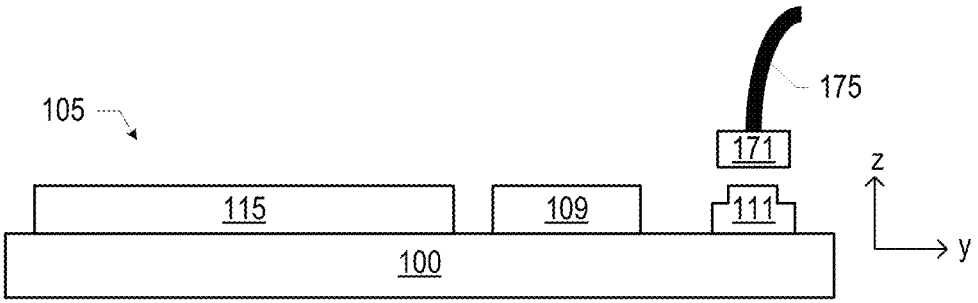

Although various ones of the accompanying drawings have illustrated the antenna board 100 as having a larger footprint than the IC package 115, the antenna board 100 and the IC package 115 (which may be, e.g., an SiP) may have any suitable relative dimensions. For example, in some embodiments, the footprint of the IC package 115 in an antenna module 105 may be larger than the footprint of the antenna board 100. Such embodiments may occur, for example, when the IC package 115 includes multiple dies as the components 336. FIGS. 21-23 illustrate various examples of antenna modules 105 in which the footprint of the IC package 115 is larger or smaller than the footprint of an antenna board 100.

As noted above, in some embodiments, an antenna module 105 may include multiple antenna boards 100. For example, FIG. 21 illustrates an embodiment in which multiple antenna boards 100 are coupled to a single IC package 115. In particular, FIG. 21A is a side, cross-sectional view, and FIG. 21B is a top view showing example components that may be included in the IC package 115. FIG. 21 also illustrates a connector 111 on the bottom face of the IC package 115, but embodiments in which multiple antenna boards 100 are coupled to a single IC package 115 may include no connectors 111 on the IC package 115, or one or more connectors 111 on the IC package 115.

As discussed above, any suitable circuitry may be included in an IC package 115. In some embodiments (e.g., the embodiments of FIGS. 21-23), the IC package 115 may include RF integrated circuits to control the operation of the antenna board 100 (e.g., one RFIC for each antenna patch 104 or antenna arrangement 103), other logic and RF control circuitry, and/or DC-DC converter circuitry (if not included separately, as discussed above with reference to FIG. 22). For example, FIG. 21 illustrates an embodiment in which the IC package 115 may include one RFIC 336-1 for each antenna board 100 (e.g., disposed above their respective antenna boards 100), one or more controller modules 336-2 (e.g., to control operation of the RFICs 336-1), one or more CMOS or BiCMOS components 336-3 to perform various RF and/or control functions, and one or more DC-DC converter components 109. In some embodiments, the components 336-3 may be limited in its output power, and may feed the RFICs 336-1. Further, the IC package 115 may include additional passive or active components, not shown (e.g., capacitors and other components to perform decoupling and/or biasing functions).

FIG. 22 illustrates an embodiment in which an IC package 115 is coupled to an antenna board 100, and a connector 111 also extends from the antenna board 100. The connector 111 may enable direct connection to antenna board 100 by a cable 175 having a connector 171 that mates with the connector 111; communication with the IC package 115 may take place through the antenna board 100. A connector 111 may take any suitable form (e.g., coaxial cable connectors or flat cable connectors).

FIG. 23 illustrates an embodiment similar to the embodiment of FIG. 22, but in which a DC-DC converter component 109 is coupled to the same face of the antenna board 100 as the IC package 115. The DC-DC converter component 109 is simply exemplary, and other components may be coupled to the antenna board 100 (instead of or in addition to the DC-DC converter component 109).

The antenna boards 100 and antenna modules 105 disclosed herein may include, or be included in, any suitable electronic component. FIGS. 24-27 illustrate various examples of apparatuses that may include, or may be included in, a communication device along with, any of the antenna boards 100 disclosed herein.

Figure 24:
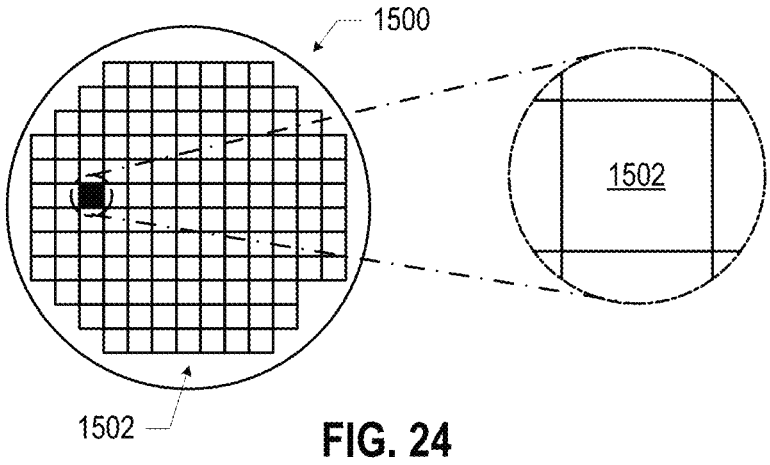
FIG. 24 is a top view of a wafer and dies that may be included in a communications device along with an antenna board, in accordance with any of the embodiments disclosed herein.

FIG. 24 is a top view of a wafer 1500 and dies 1502 that may be included in a communication device along with any of the antenna boards 100 disclosed herein. The wafer 1500 may be composed of semiconductor material and may include one or more dies 1502 having IC structures formed on a surface of the wafer 1500. Each of the dies 1502 may be a repeating unit of a semiconductor product that includes any suitable IC. After the fabrication of the semiconductor product is complete, the wafer 1500 may undergo a singulation process in which the dies 1502 are separated from one another to provide discrete "chips" of the semiconductor product. The die 1502 may include one or more transistors (e.g., some of the transistors 1640 of FIG. 25, discussed below) and/or supporting circuitry to route electrical signals to the transistors, as well as any other IC components. In some embodiments, the wafer 1500 or the die 1502 may include a memory device (e.g., a random access memory (RAM) device, such as a static RAM (SRAM) device, a magnetic RAM (MRAM) device, a resistive RAM (RRAM) device, a conductive-bridging RAM (CBRAM) device, etc.), a logic device (e.g., an AND, OR, NAND, or NOR gate), or any other suitable circuit element. Multiple ones of these devices may be combined on a single die 1502. For example, a memory array formed by multiple memory devices may be formed on a same die 1502 as a processing device (e.g., the processing device 1802 of FIG. 27) or other logic that is configured to store information in the memory devices or execute instructions stored in the memory array.

Figure 25:
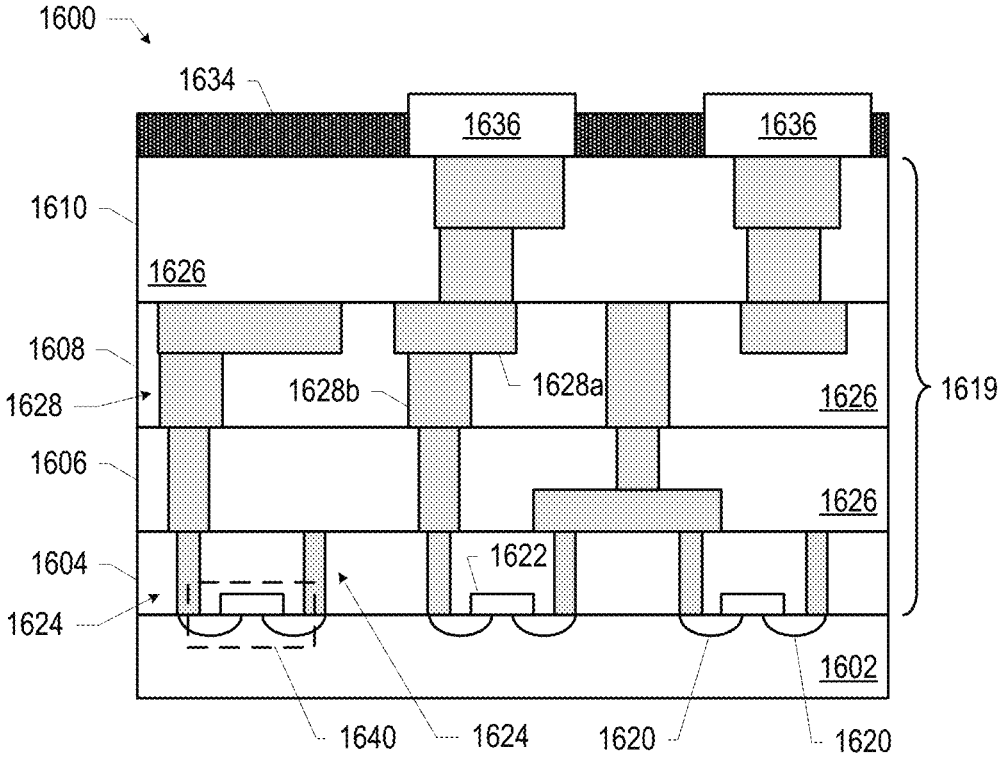
FIG. 25 is a side, cross-sectional view of an IC device that may be included in a communications device along with an antenna board, in accordance with any of the embodiments disclosed herein.

FIG. 25 is a side, cross-sectional view of an IC device 1600 that may be included in a communication device along with any of the antenna boards 100 disclosed herein. The IC device 1600 may be formed on a substrate 1602 (e.g., the wafer 1500 of FIG. 24) and may be included in a die (e.g., the die 1502 of FIG. 24). The substrate 1602 may be a semiconductor substrate composed of semiconductor material systems including, for example, n-type or p-type materials systems (or a combination of both). The substrate 1602 may include, for example, a crystalline substrate formed using a bulk silicon or a silicon-on-insulator (SOI) substructure. In some embodiments, the substrate 1602 may be formed using alternative materials, which may or may not be combined with silicon, that include but are not limited to germanium, indium antimonide, lead telluride, indium arsenide, indium phosphide, gallium arsenide, or gallium antimonide. Further materials classified as group II-VI, III-V, or IV may also be used to form the substrate 1602. Although a few examples of materials from which the substrate 1602 may be formed are described here, any material that may serve as a foundation for an IC device 1600 may be used. The substrate 1602 may be part of a singulated die (e.g., the dies 1502 of FIG. 24) or a wafer (e.g., the wafer 1500 of FIG. 24).

The IC device 1600 may include one or more device layers 1604 disposed on the substrate 1602. The device layer 1604 may include features of one or more transistors 1640 (e.g., metal oxide semiconductor field-effect transistors (MOSFETs)) formed on the substrate 1602. The device layer 1604 may include, for example, one or more source and/or drain (S/D) regions 1620, a gate 1622 to control current flow in the transistors 1640 between the S/D regions 1620, and one or more S/D contacts 1624 to route electrical signals to/from the S/D regions 1620. The transistors 1640 may include additional features not depicted for the sake of clarity, such as device isolation regions, gate contacts, and the like. The transistors 1640 are not limited to the type and configuration depicted in FIG. 25 and may include a wide variety of other types and configurations such as, for example, planar transistors, non-planar transistors, or a combination of both. Planar transistors may include bipolar junction transistors (BJT), heterojunction bipolar transistors (HBT), or high-electron-mobility transistors (HEMT). Non-planar transistors may include FinFET transistors, such as double-gate transistors or tri-gate transistors, and wrap-around or all-around gate transistors, such as nanoribbon and nanowire transistors.

Each transistor 1640 may include a gate 1622 formed of at least two layers, a gate dielectric and a gate electrode. The gate dielectric may include one layer or a stack of layers. The one or more layers may include silicon oxide, silicon dioxide, silicon carbide, and/or a high-k dielectric material. The high-k dielectric material may include elements such as hafnium, silicon, oxygen, titanium, tantalum, lanthanum, aluminum, zirconium, barium, strontium, yttrium, lead, scandium, niobium, and zinc. Examples of high-k materials that may be used in the gate dielectric include, but are not limited to, hafnium oxide, hafnium silicon oxide, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate. In some embodiments, an annealing process may be carried out on the gate dielectric to improve its quality when a high-k material is used.

The gate electrode may be formed on the gate dielectric and may include at least one p-type work function metal or n-type work function metal, depending on whether the transistor 1640 is to be a p-type metal oxide semiconductor (PMOS) or an n-type metal oxide semiconductor (NMOS) transistor. In some implementations, the gate electrode may consist of a stack of two or more metal layers, where one or more metal layers are work function metal layers and at least one metal layer is a fill metal layer. Further metal layers may be included for other purposes, such as a barrier layer. For a PMOS transistor, metals that may be used for the gate electrode include, but are not limited to, ruthenium, palladium, platinum, cobalt, nickel, conductive metal oxides (e.g., ruthenium oxide), and any of the metals discussed below with reference to an NMOS transistor (e.g., for work function tuning). For an NMOS transistor, metals that may be used for the gate electrode include, but are not limited to, hafnium, zirconium, titanium, tantalum, aluminum, alloys of these metals, carbides of these metals (e.g., hafnium carbide, zirconium carbide, titanium carbide, tantalum carbide, and aluminum carbide), and any of the metals discussed above with reference to a PMOS transistor (e.g., for work function tuning).

In some embodiments, when viewed as a cross-section of the transistor 1640 along the source-channel-drain direction, the gate electrode may consist of a U-shaped structure that includes a bottom portion substantially parallel to the surface of the substrate and two sidewall portions that are substantially perpendicular to the top surface of the substrate. In other embodiments, at least one of the metal layers that form the gate electrode may simply be a planar layer that is substantially parallel to the top surface of the substrate and does not include sidewall portions substantially perpendicular to the top surface of the substrate. In other embodiments, the gate electrode may consist of a combination of U-shaped structures and planar, non-U-shaped structures. For example, the gate electrode may consist of one or more U-shaped metal layers formed atop one or more planar, non-U-shaped layers.

In some embodiments, a pair of sidewall spacers may be formed on opposing sides of the gate stack to bracket the gate stack. The sidewall spacers may be formed from materials such as silicon nitride, silicon oxide, silicon carbide, silicon nitride doped with carbon, and silicon oxynitride. Processes for forming sidewall spacers are well known in the art and generally include deposition and etching process steps. In some embodiments, a plurality of spacer pairs may be used; for instance, two pairs, three pairs, or four pairs of sidewall spacers may be formed on opposing sides of the gate stack.

The S/D regions 1620 may be formed within the substrate 1602 adjacent to the gate 1622 of each transistor 1640. The S/D regions 1620 may be formed using an implantation/diffusion process or an etching/deposition process, for example. In the former process, dopants such as boron, aluminum, antimony, phosphorous, or arsenic may be ion-implanted into the substrate 1602 to form the S/D regions 1620. An annealing process that activates the dopants and causes them to diffuse farther into the substrate 1602 may follow the ion-implantation process. In the latter process, the substrate 1602 may first be etched to form recesses at the locations of the S/D regions 1620. An epitaxial deposition process may then be carried out to fill the recesses with material that is used to fabricate the S/D regions 1620. In some implementations, the S/D regions 1620 may be fabricated using a silicon alloy such as silicon germanium or silicon carbide. In some embodiments, the epitaxially deposited silicon alloy may be doped in situ with dopants such as boron, arsenic, or phosphorous. In some embodiments, the S/D regions 1620 may be formed using one or more alternate semiconductor materials such as germanium or a group III-V material or alloy. In further embodiments, one or more layers of metal and/or metal alloys may be used to form the S/D regions 1620.

Electrical signals, such as power and/or input/output (I/O) signals, may be routed to and/or from the devices (e.g., the transistors 1640) of the device layer 1604 through one or more interconnect layers disposed on the device layer 1604 (illustrated in FIG. 25 as interconnect layers 1606-1610). For example, electrically conductive features of the device layer 1604 (e.g., the gate 1622 and the S/D contacts 1624) may be electrically coupled with the interconnect structures 1628 of the interconnect layers 1606-1610. The one or more interconnect layers 1606-1610 may form a metallization stack (also referred to as an "ILD stack") 1619 of the IC device 1600.

The interconnect structures 1628 may be arranged within the interconnect layers 1606-1610 to route electrical signals according to a wide variety of designs (in particular, the arrangement is not limited to the particular configuration of interconnect structures 1628 depicted in FIG. 25). Although a particular number of interconnect layers 1606-1610 is depicted in FIG. 25, embodiments of the present disclosure include IC devices having more or fewer interconnect layers than depicted.

In some embodiments, the interconnect structures 1628 may include lines 1628*a* and/or vias 1628*b* filled with an electrically conductive material such as a metal. The lines 1628*a* may be arranged to route electrical signals in a direction of a plane that is substantially parallel with a surface of the substrate 1602 upon which the device layer 1604 is formed. For example, the lines 1628*a* may route electrical signals in a direction in and out of the page from the perspective of FIG. 25. The vias 1628*b* may be arranged to route electrical signals in a direction of a plane that is substantially perpendicular to the surface of the substrate 1602 upon which the device layer 1604 is formed. In some embodiments, the vias 1628*b* may electrically couple lines 1628*a* of different interconnect layers 1606-1610 together.

The interconnect layers 1606-1610 may include a dielectric material 1626 disposed between the interconnect structures 1628, as shown in FIG. 25. In some embodiments, the dielectric material 1626 disposed between the interconnect structures 1628 in different ones of the interconnect layers 1606-1610 may have different compositions; in other embodiments, the composition of the dielectric material 1626 between different interconnect layers 1606-1610 may be the same.

A first interconnect layer 1606 may be formed above the device layer 1604. In some embodiments, the first interconnect layer 1606 may include lines 1628*a* and/or vias 1628*b*, as shown. The lines 1628*a* of the first interconnect layer 1606 may be coupled with contacts (e.g., the S/D contacts 1624) of the device layer 1604.

A second interconnect layer 1608 may be formed above the first interconnect layer 1606. In some embodiments, the second interconnect layer 1608 may include vias 1628*b* to couple the lines 1628*a* of the second interconnect layer 1608 with the lines 1628*a* of the first interconnect layer 1606. Although the lines 1628*a* and the vias 1628*b* are structurally delineated with a line within each interconnect layer (e.g., within the second interconnect layer 1608) for the sake of clarity, the lines 1628*a* and the vias 1628*b* may be structurally and/or materially contiguous (e.g., simultaneously filled during a dual-damascene process) in some embodiments.

A third interconnect layer 1610 (and additional interconnect layers, as desired) may be formed in succession on the second interconnect layer 1608 according to similar techniques and configurations described in connection with the second interconnect layer 1608 or the first interconnect layer 1606. In some embodiments, the interconnect layers that are "higher up" in the metallization stack 1619 in the IC device 1600 (i.e., farther away from the device layer 1604) may be thicker.

The IC device 1600 may include a solder resist material 1634 (e.g., polyimide or similar material) and one or more conductive contacts 1636 formed on the interconnect layers 1606-1610. In FIG. 25, the conductive contacts 1636 are illustrated as taking the form of bond pads. The conductive contacts 1636 may be electrically coupled with the interconnect structures 1628 and configured to route the electrical signals of the transistor(s) 1640 to other external devices. For example, solder bonds may be formed on the one or more conductive contacts 1636 to mechanically and/or electrically couple a chip including the IC device 1600 with another component (e.g., a circuit board). The IC device 1600 may include additional or alternate structures to route the electrical signals from the interconnect layers 1606-1610; for example, the conductive contacts 1636 may include other analogous features (e.g., posts) that route the electrical signals to external components.

Figure 26:
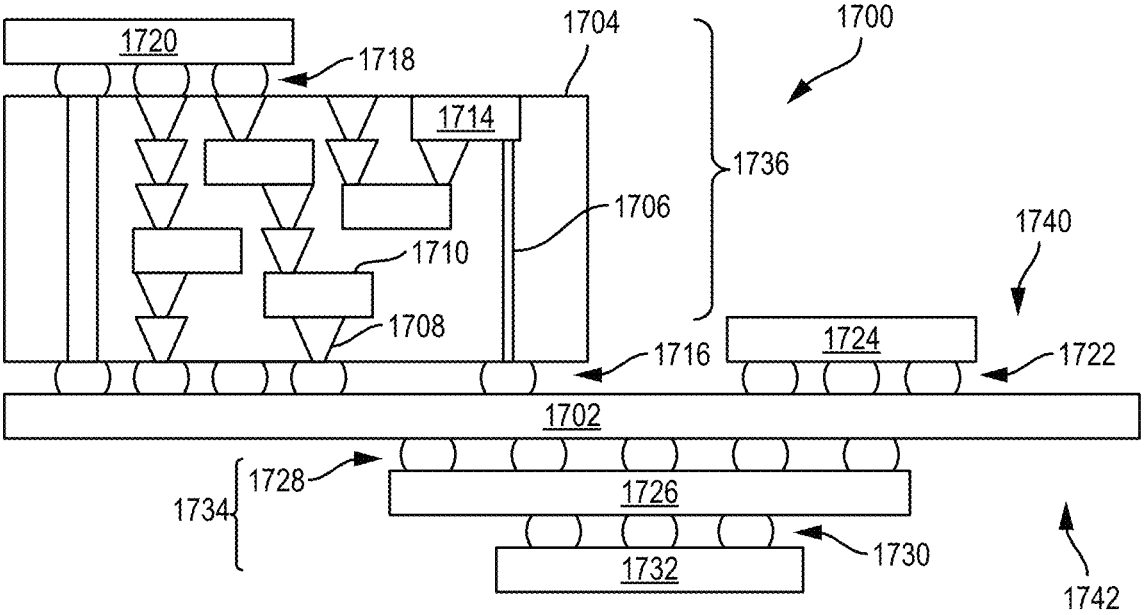
FIG. 26 is a side, cross-sectional view of an IC device assembly that may include an antenna board, in accordance with any of the embodiments disclosed herein.

FIG. 26 is a side, cross-sectional view of an IC device assembly 1700 that may include one or more of the antenna boards 100 disclosed herein. In particular, any suitable ones of the antenna boards 100 disclosed herein may take the place of any of the components of the IC device assembly 1700 (e.g., an antenna board 100 may take the place of any of the IC packages of the IC device assembly 1700).

The IC device assembly 1700 includes a number of components disposed on a circuit board 1702 (which may be, e.g., a motherboard). The IC device assembly 1700 includes components disposed on a first face 1740 of the circuit board 1702 and an opposing second face 1742 of the circuit board 1702; generally, components may be disposed on one or both faces 1740 and 1742.

In some embodiments, the circuit board 1702 may be a PCB including multiple metal layers separated from one another by layers of dielectric material and interconnected by electrically conductive vias. Any one or more of the metal layers may be formed in a desired circuit pattern to route electrical signals (optionally in conjunction with other metal layers) between the components coupled to the circuit board 1702. In other embodiments, the circuit board 1702 may be a non-PCB substrate.

The IC device assembly 1700 illustrated in FIG. 26 includes a package-on-interposer structure 1736 coupled to the first face 1740 of the circuit board 1702 by coupling components 1716. The coupling components 1716 may electrically and mechanically couple the package-on-interposer structure 1736 to the circuit board 1702, and may include solder balls (as shown in FIG. 26), male and female portions of a socket, an adhesive, an underfill material, and/or any other suitable electrical and/or mechanical coupling structure.

The package-on-interposer structure 1736 may include an IC package 1720 coupled to an interposer 1704 by coupling components 1718. The coupling components 1718 may take any suitable form for the application, such as the forms discussed above with reference to the coupling components 1716. Although a single IC package 1720 is shown in FIG. 26, multiple IC packages may be coupled to the interposer 1704; indeed, additional interposers may be coupled to the interposer 1704. The interposer 1704 may provide an intervening substrate used to bridge the circuit board 1702 and the IC package 1720. The IC package 1720 may be or include, for example, a die (the die 1502 of FIG. 24), an IC device (e.g., the IC device 1600 of FIG. 25), or any other suitable component. Generally, the interposer 1704 may spread a connection to a wider pitch or reroute a connection to a different connection. For example, the interposer 1704 may couple the IC package 1720 (e.g., a die) to a set of ball grid array (BGA) conductive contacts of the coupling components 1716 for coupling to the circuit board 1702. In the embodiment illustrated in FIG. 26, the IC package 1720 and the circuit board 1702 are attached to opposing sides of the interposer 1704; in other embodiments, the IC package 1720 and the circuit board 1702 may be attached to the same side of the interposer 1704. In some embodiments, three or more components may be interconnected by way of the interposer 1704.

In some embodiments, the interposer 1704 may be formed as a PCB, including multiple metal layers separated from one another by layers of dielectric material and interconnected by electrically conductive vias. In some embodiments, the interposer 1704 may be formed of an epoxy resin, a fiberglass-reinforced epoxy resin, an epoxy resin with inorganic fillers, a ceramic material, or a polymer material such as polyimide. In some embodiments, the interposer 1704 may be formed of alternate rigid or flexible materials that may include the same materials described above for use in a semiconductor substrate, such as silicon, germanium, and other group III-V and group IV materials. The interposer 1704 may include metal interconnects 1708 and vias 1710, including but not limited to through-silicon vias (TSVs) 1706. The interposer 1704 may further include embedded devices 1714, including both passive and active devices. Such devices may include, but are not limited to, capacitors, decoupling capacitors, resistors, inductors, fuses, diodes, transformers, sensors, electrostatic discharge (ESD) devices, and memory devices. More complex devices such as RF devices, power amplifiers, power management devices, antennas, arrays, sensors, and microelectromechanical systems (MEMS) devices may also be formed on the interposer 1704. The package-on-interposer structure 1736 may take the form of any of the package-on-interposer structures known in the art.

The IC device assembly 1700 may include an IC package 1724 coupled to the first face 1740 of the circuit board 1702 by coupling components 1722. The coupling components 1722 may take the form of any of the embodiments discussed above with reference to the coupling components 1716, and the IC package 1724 may take the form of any of the embodiments discussed above with reference to the IC package 1720.

The IC device assembly 1700 illustrated in FIG. 26 includes a package-on-package structure 1734 coupled to the second face 1742 of the circuit board 1702 by coupling components 1728. The package-on-package structure 1734 may include an IC package 1726 and an IC package 1732 coupled together by coupling components 1730 such that the IC package 1726 is disposed between the circuit board 1702 and the IC package 1732. The coupling components 1728 and 1730 may take the form of any of the embodiments of the coupling components 1716 discussed above, and the IC packages 1726 and 1732 may take the form of any of the embodiments of the IC package 1720 discussed above. The package-on-package structure 1734 may be configured in accordance with any of the package-on-package structures known in the art.

Figure 27:
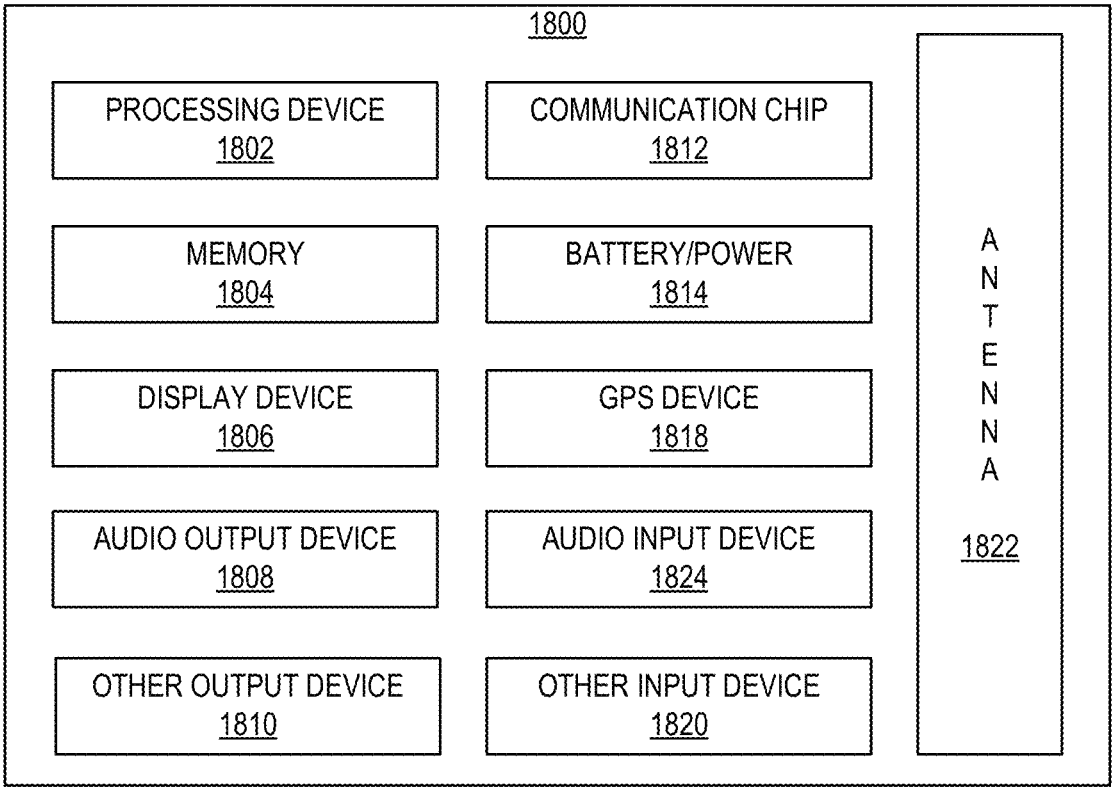
FIG. 27 is a block diagram of an example communication device that may include an antenna board, in accordance with any of the embodiments disclosed herein.

FIG. 27 is a block diagram of an example communication device 1800 that may include one or more antenna boards 100, in accordance with any of the embodiments disclosed herein. For example, the communication device 151 (FIG. 25) may be an example of the communication device 1800. Any suitable ones of the components of the communication device 1800 may include one or more of the IC device assemblies 1700, IC devices 1600, or dies 1502 disclosed herein. A number of components are illustrated in FIG. 27 as included in the communication device 1800, but any one or more of these components may be omitted or duplicated, as suitable for the application. In some embodiments, some or all of the components included in the communication device 1800 may be attached to one or more motherboards. In some embodiments, some or all of these components are fabricated onto a single system-on-a-chip (SoC) die.

Additionally, in various embodiments, the communication device 1800 may not include one or more of the components illustrated in FIG. 27, but the communication device 1800 may include interface circuitry for coupling to the one or more components. For example, the communication device 1800 may not include a display device 1806, but may include display device interface circuitry (e.g., a connector and driver circuitry) to which a display device 1806 may be coupled. In another set of examples, the communication device 1800 may not include an audio input device 1824 or an audio output device 1808, but may include audio input or output device interface circuitry (e.g., connectors and supporting circuitry) to which an audio input device 1824 or audio output device 1808 may be coupled.

The communication device 1800 may include a processing device 1802 (e.g., one or more processing devices). As used herein, the term "processing device" or "processor" may refer to any device or portion of a device that processes electronic data from registers and/or memory to transform that electronic data into other electronic data that may be stored in registers and/or memory. The processing device 1802 may include one or more digital signal processors (DSPs), application-specific integrated circuits (ASICs), central processing units (CPUs), graphics processing units (GPUs), cryptoprocessors (specialized processors that execute cryptographic algorithms within hardware), server processors, or any other suitable processing devices. The communication device 1800 may include a memory 1804, which may itself include one or more memory devices such as volatile memory (e.g., dynamic random access memory (DRAM)), nonvolatile memory (e.g., read-only memory (ROM)), flash memory, solid state memory, and/or a hard drive. In some embodiments, the memory 1804 may include memory that shares a die with the processing device 1802. This memory may be used as cache memory and may include embedded dynamic random access memory (eDRAM) or spin transfer torque magnetic random access memory (STT-MRAM).

In some embodiments, the communication device 1800 may include a communication module 1812 (e.g., one or more communication modules). For example, the communication module 1812 may be configured for managing wireless communications for the transfer of data to and from the communication device 1800. The term "wireless" and its derivatives may be used to describe circuits, devices, systems, methods, techniques, communications channels, etc., that may communicate data through the use of modulated electromagnetic radiation through a nonsolid medium. The term does not imply that the associated devices do not contain any wires, although in some embodiments they might not. The communication module 1812 may be, or may include, any of the antenna boards 100 disclosed herein.

The communication module 1812 may implement any of a number of wireless standards or protocols, including but not limited to Institute for Electrical and Electronic Engineers (IEEE) standards including Wi-Fi (IEEE 802.11 family), IEEE 802.16 standards (e.g., IEEE 802.16-2005 Amendment), Long-Term Evolution (LTE) project along with any amendments, updates, and/or revisions (e.g., advanced LTE project, ultra mobile broadband (UMB) project (also referred to as "3GPP2"), etc.). IEEE 802.16 compatible Broadband Wireless Access (BWA) networks are generally referred to as WiMAX networks, an acronym that stands for Worldwide Interoperability for Microwave Access, which is a certification mark for products that pass conformity and interoperability tests for the IEEE 802.16 standards. The communication module 1812 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication module 1812 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication module 1812 may operate in accordance with Code Division Multiple Access (CDMA), Time Division Multiple Access (TDMA), Digital Enhanced Cordless Telecommunications (DECT), Evolution-Data Optimized (EV-DO), and derivatives thereof, as well as any other wireless protocols that are designated as 3G, 4G, 5G, and beyond. The communication module 1812 may operate in accordance with other wireless protocols in other embodiments. The communication device 1800 may include an antenna 1822 to facilitate wireless communications and/or to receive other wireless communications (such as AM or FM radio transmissions).

In some embodiments, the communication module 1812 may manage wired communications, such as electrical, optical, or any other suitable communication protocols (e.g., the Ethernet). As noted above, the communication module 1812 may include multiple communication modules. For instance, a first communication module 1812 may be dedicated to shorter-range wireless communications such as Wi-Fi or Bluetooth, and a second communication module 1812 may be dedicated to longer-range wireless communications such as global positioning system (GPS), EDGE, GPRS, CDMA, WiMAX, LTE, EV-DO, or others. In some embodiments, a first communication module 1812 may be dedicated to wireless communications, and a second communication module 1812 may be dedicated to wired communications. In some embodiments, the communication module 1812 may include an antenna board 100 that supports millimeter wave communication.

The communication device 1800 may include battery/power circuitry 1814. The battery/power circuitry 1814 may include one or more energy storage devices (e.g., batteries or capacitors) and/or circuitry for coupling components of the communication device 1800 to an energy source separate from the communication device 1800 (e.g., AC line power).

The communication device 1800 may include a display device 1806 (or corresponding interface circuitry, as discussed above). The display device 1806 may include any visual indicators, such as a heads-up display, a computer monitor, a projector, a touchscreen display, a liquid crystal display (LCD), a light-emitting diode display, or a flat panel display.

The communication device 1800 may include an audio output device 1808 (or corresponding interface circuitry, as discussed above). The audio output device 1808 may include any device that generates an audible indicator, such as speakers, headsets, or earbuds.

The communication device 1800 may include an audio input device 1824 (or corresponding interface circuitry, as discussed above). The audio input device 1824 may include any device that generates a signal representative of a sound, such as microphones, microphone arrays, or digital instruments (e.g., instruments having a musical instrument digital interface (MIDI) output).

The communication device 1800 may include a GPS device 1818 (or corresponding interface circuitry, as discussed above). The GPS device 1818 may be in communication with a satellite-based system and may receive a location of the communication device 1800, as known in the art.

The communication device 1800 may include an other output device 1810 (or corresponding interface circuitry, as discussed above). Examples of the other output device 1810 may include an audio codec, a video codec, a printer, a wired or wireless transmitter for providing information to other devices, or an additional storage device.

The communication device 1800 may include an other input device 1820 (or corresponding interface circuitry, as discussed above). Examples of the other input device 1820 may include an accelerometer, a gyroscope, a compass, an image capture device, a keyboard, a cursor control device such as a mouse, a stylus, a touchpad, a bar code reader, a Quick Response (QR) code reader, any sensor, or a radio frequency identification (RFID) reader.

The communication device 1800 may have any desired form factor, such as a handheld or mobile communication device (e.g., a cell phone, a smart phone, a mobile internet device, a music player, a tablet computer, a laptop computer, a netbook computer, an ultrabook computer, a personal digital assistant (PDA), an ultra mobile personal computer, etc.), a tablet communication device, a desktop communication device, a server or other networked computing component, a printer, a scanner, a monitor, a set-top box, an entertainment control unit, a vehicle control unit, a digital camera, a digital video recorder, or a wearable communication device. In some embodiments, the communication device 1800 may be any other electronic device that processes data.

The following paragraphs provide examples of various ones of the embodiments disclosed herein.

Example 1 is an antenna board, including: a plurality of antenna patches coupled to a dielectric material; and a plurality of pedestals extending from a face of the dielectric material and at least partially embedded in the dielectric material.

Example 2 includes the subject matter of Example 1, and further specifies that individual pedestals include a first portion with a first width and a second portion with a second width, and the second width is different from the first width.

Example 3 includes the subject matter of Example 2, and further specifies that individual pedestals further include a third portion with a third width, and the first portion is between the second portion and the third portion.

Example 4 includes the subject matter of Example 3, and further specifies that the second width is less than the first width, and the first width is less than or equal to the third width.

Example 5 includes the subject matter of any of Examples 3-4, and further specifies that the third portion is embedded in the dielectric material.

Example 6 includes the subject matter of any of Examples 2-5, and further specifies that the second width is less than the first width.

Example 7 includes the subject matter of any of Examples 1-6, and further includes: first and second portions of conductive material, wherein the plurality of antenna patches are between the first and second portions of conductive material.

Example 8 includes the subject matter of Example 7, and further specifies that the first and second portions of conductive material are coplanar with the plurality of antenna patches.

Example 9 includes the subject matter of any of Examples 7-8, and further specifies that the plurality of pedestals are between the first and second portions of conductive material.

Example 10 includes the subject matter of any of Examples 7-9, and further specifies that individual pedestals are in conductive contact with the first and second portions of conductive material.

Example 11 includes the subject matter of any of Examples 1-10, and further specifies that individual pedestals have a square footprint.

Example 12 includes the subject matter of any of Examples 1-10, and further specifies that individual pedestals have a non-square rectangular footprint.

Example 13 includes the subject matter of any of Examples 1-10, and further specifies that individual pedestals have a circular footprint.

Example 14 includes the subject matter of any of Examples 1-13, and further specifies that individual pedestals extend from the face of the dielectric material by a distance between 15 microns and 40 microns.

Example 15 includes the subject matter of any of Examples 1-14, and further includes: a ground plane substrate, wherein the ground plane substrate includes a ground plane for the antenna patches, and individual pedestals are electrically coupled to the ground plane substrate.

Example 16 includes the subject matter of any of Examples 15, and further specifies that individual pedestals and the ground plane are part of an antenna feed structure.

Example 17 includes the subject matter of any of Examples 15-16, and further includes: an air cavity between individual antenna patches and the ground plane substrate.

Example 18 includes the subject matter of any of Examples 15-17, and further specifies that the ground plane substrate includes additional antenna patches on a face of the ground plane substrate.

Example 19 includes the subject matter of any of Examples 15-18, and further specifies that the ground plane substrate includes additional antenna patches on both opposing faces of the ground plane substrate.

Example 20 includes the subject matter of any of Examples 15-19, and further specifies that the individual pedestals are electrically coupled to the ground plane substrate by solder balls having a non-solder core.

Example 21 includes the subject matter of Example 20, and further specifies that the non-solder core includes copper or plastic.

Example 22 includes the subject matter of any of Examples 15-21, and further includes: adhesive between the dielectric material and the ground plane substrate.

Example 23 includes the subject matter of Example 22, and further specifies that the adhesive is in contact with the dielectric material and the ground plane substrate.

Example 24 includes the subject matter of any of Examples 1-23, and further specifies that the plurality of antenna patches are a first plurality of antenna patches, the dielectric material is a first dielectric material, the plurality of pedestals is a first plurality of pedestals, and the antenna board further includes: a second plurality of antenna patches coupled to a second dielectric material; and a second plurality of pedestals extending from a face of the second dielectric material and at least partially embedded in the second dielectric material, wherein the second plurality of pedestals are electrically coupled to the first plurality of pedestals.

Example 25 includes the subject matter of any of Examples 1-24, and further specifies that the plurality of antenna patches are embedded in the dielectric material.

Example 26 is an antenna board, including: a ground plane substrate; and a millimeter wave antenna coupled to the ground plane substrate.

Example 27 includes the subject matter of Example 26, and further specifies that the millimeter wave antenna has a central portion and leg portions extending at an angle from the central portion.

Example 28 includes the subject matter of Example 26, and further specifies that the millimeter wave antenna is substantially flat.

Example 29 includes the subject matter of any of Examples 26-28, and further specifies that the millimeter wave antenna has a circular footprint.

Example 30 includes the subject matter of any of Examples 26-29, and further specifies that the millimeter wave antenna is coupled to the ground plane substrate by solder at a location at a periphery of the millimeter wave antenna.

Example 31 includes the subject matter of any of Examples 26-30, and further specifies that the millimeter wave antenna is coupled to the ground plane substrate by solder at a location at an interior of the millimeter wave antenna.

Example 32 includes the subject matter of any of Examples 26-31, and further specifies that the millimeter wave antenna is coupled to the ground plane substrate by solder at a location at a center of the millimeter wave antenna.

Example 33 includes the subject matter of any of Examples 26-32, and further specifies that the ground plane substrate includes at least a portion of an antenna feed structure, the antenna feed structure includes a feed portion that is not in physical contact with the millimeter wave antenna, and an end of the feed portion is proximate to a periphery of the millimeter wave antenna.

Example 34 includes the subject matter of Example 33, and further specifies that the end of the feed portion is coplanar with a plane of the millimeter wave antenna.

Example 35 includes the subject matter of any of Examples 26-34, and further includes: an air cavity between the millimeter wave antenna and the ground plane substrate.

Example 36 is an antenna board, including: a millimeter wave antenna patch; and an antenna feed structure including a ground plane, a feed portion perpendicular to the ground plane and perpendicular to the millimeter wave antenna patch, wherein the feed portion is not in a shadow of the antenna feed structure.

Example 37 includes the subject matter of Example 36, and further includes: an air cavity between the millimeter wave antenna patch and the ground plane.

Example 38 includes the subject matter of any of Examples 36-37, and further specifies that the antenna feed structure includes solder.

Example 39 includes the subject matter of Example 38, and further specifies that the solder includes a solder ball having a non-solder core.

Example 40 is a communication device, including: a display; a back cover; and an antenna board in accordance with any of claims 1-39 between the display and the back cover.

Example 41 includes the subject matter of Example 40, and further specifies that the back cover includes glass.

Example 42 includes the subject matter of any of Examples 40-41, and further specifies that the communication device is a handheld communication device.

Example 43 includes the subject matter of any of Examples 40-42, and further specifies that the communication device is a tablet communication device.

The invention claimed is:

1. An antenna board, comprising:

a plurality of antenna patches coupled to a dielectric material; and a plurality of pedestals extending from a face of the dielectric material and at least partially embedded in the dielectric material, wherein:

a surface of each antenna patch in the plurality of antenna patches is coplanar with a face of the antenna board, each pedestal comprises a first portion coplanar with the face of the antenna board, and a second portion extending from the face of the antenna board, and individual pedestals in the plurality of pedestals are distributed around individual antenna patches in the plurality of antenna patches.

2. The antenna board of claim 1, wherein the first portion has a first width and a second portion has a second width, and the second width is different from the first width.

3. The antenna board of claim 2, wherein individual pedestals further include a third portion with a third width, and the first portion is between the second portion and the third portion.

4. The antenna board of claim 3, wherein the second width is less than the first width, and the first width is less than or equal to the third width.

5. The antenna board of claim 3, wherein the third portion is embedded in the dielectric material.

6. The antenna board of claim 2, wherein the second width is less than the first width.

7. The antenna board of claim 1, further comprising:

first and second portions of conductive material, wherein the plurality of antenna patches are between the first and second portions of conductive material.

8. The antenna board of claim 7, wherein the first and second portions of conductive material are coplanar with the plurality of antenna patches.

9. The antenna board of claim 1, further comprising:

a ground plane substrate, wherein the ground plane substrate includes a ground plane for the antenna patches, and individual pedestals are electrically coupled to the ground plane substrate.

10. The antenna board of claim 9, further comprising:

an air cavity between individual antenna patches and the ground plane substrate.

11. The antenna board of claim 9, further comprising:

adhesive between the dielectric material and the ground plane substrate.

12. An antenna board, comprising:

a ground plane substrate; and a millimeter wave antenna coupled to the ground plane substrate, wherein:

the millimeter wave antenna is non-planar, and the millimeter wave antenna has a planar central portion and leg portions extending at an angle away from the planar central portion.

13. The antenna board of claim 12, wherein the angle is ninety degrees relative to the planar central portion.

14. The antenna board of claim 12, wherein the millimeter wave antenna has a circular footprint.

15. The antenna board of claim 12, wherein the millimeter wave antenna is coupled to the ground plane substrate by solder at a location at a periphery of the millimeter wave antenna.

16. The antenna board of claim 12, wherein the millimeter wave antenna is coupled to the ground plane substrate by solder at a location at an interior of the millimeter wave antenna.

17. An antenna board, comprising:

a millimeter wave antenna patch; and an antenna feed structure including a ground plane, a feed portion perpendicular to the ground plane and perpendicular to the millimeter wave antenna patch, wherein:

the feed portion is not in a shadow of the antenna feed structure, the ground plane is not coplanar with the millimeter wave antenna patch, a first end of the feed portion having a first width is in an opening in the ground plane, a second end of the feed portion having a second width is coplanar with the millimeter wave antenna patch, and the first width is smaller than the second width.

18. The antenna board of claim 17, further comprising:

an air cavity between the millimeter wave antenna patch and the ground plane.

19. The antenna board of claim 17, wherein the antenna feed structure includes solder.

20. The antenna board of claim 19, wherein the solder includes a solder ball having a non-solder core.

* * * * *